United States Patent [19]

Ogawa

[11] 3,951,540

[45] Apr. 20, 1976

[54] ELECTROPHOTOGRAPHIC COPIER OF TRANSFER TYPE

[75] Inventor: Masaya Ogawa, Osaka, Japan

[73] Assignee: Minolta Camera Kabushiki Kaisha, Osaka, Japan

[22] Filed: Sept. 25, 1974

[21] Appl. No.: 509,180

Related U.S. Application Data

[60] Division of Ser. No. 347,530, April 3, 1973, Pat. No. 3,873,196, which is a continuation of Ser. No. 167,398, July 29, 1971, abandoned.

[30] Foreign Application Priority Data

| | | |
|---|---|---|
| Dec. 24, 1970 | Japan | 45-127087 |
| Aug. 3, 1970 | Japan | 45-77348[U] |
| Sept. 18, 1970 | Japan | 45-93418[U] |

[52] U.S. Cl. ..... 355/8

[51] Int. Cl.[2] ..... G03G 15/28

[58] Field of Search ..... 355/8, 65, 66

[56] References Cited

UNITED STATES PATENTS

| | | | |
|---|---|---|---|
| 968,312 | 8/1910 | Bacon | 74/422 |
| 3,720,466 | 3/1973 | Koizumi | 355/8 |

*Primary Examiner*—John Gonzales

*Attorney, Agent, or Firm*—Wolder & Gross

[57] ABSTRACT

An exposure optical system for continuously projecting the image of an original on a document table onto a moving photoreceptor includes a first carriage equipped with document illuminating means to be moved in synchronism with the photoreceptor and a second carriage to be moved at half the speed of the first carriage in operative relation thereto by a rotary member and equipped with a reflecting optical system. Thus the reciprocal movement of the carriages is effected with a simple mechanism to greatly reduce the space occupied by the exposure optical system and thereby provide a compact copier. Paper feed means includes a mechanism for temporarily interrupting the feed of paper and then intermittently sending out the paper to an image transfer station in synchronism with the movement of the photoreceptor. In order to rotate an endless support of the photoreceptor one turn more than the preset number of copies to be made, the switches of a program circuit for controlling the respective operations are opened and closed by a control member rotated in synchronism with the endless support.

5 Claims, 28 Drawing Figures

ELECTROPHOTOGRAPHIC COPIER OF TRANSFER TYPE

REFERENCE TO CO-PENDING APPLICATIONS

The present application is a division of U.S. Pat. application Ser. No. 347,530 filed Apr. 3, 1973, now U.S. Pat. No. 3,873,196 granted Mar. 25, 1975 which in turn is a continuation of application Ser. No. 167,398 filed July 29, 1971 now abandoned.

BACKGROUND OF THE INVENTION

The present invention relates to electrophotographic copiers for copying books, sheets of documents and the like, more particularly to an electrophotographic copier of the transfer type which employs the Carlson system for the formation of the image and in which the image of an original document placed on a transparent document table is continuously projected onto a photoreceptor on a rotating or moving endless support by an exposure optical system of the slit scanning type and the latent image of the document thus formed is then rendered visible with a toner and transferred onto ordinary paper.

The copier of this type is known by the trade name of "Xerox 914," etc. However, the copiers heretofore known have the following drawback:

1. Since the photoreceptor is integrally formed on the surface of a drum by a vacuum evaporation, the photoreceptor has to be replaced together with the drum when the photoreceptor gets deteriorated, hence the replacement of the photoreceptor is expensive.
2. With the exposure optical system of the slit scanning type, the document illuminating system and projecting lens have to be travelled in parallel with the document at a speed proportional to the peripheral speed of the photoreceptor on the drum. Consequently, the exposure is not always effected with principal rays from the lens and the varying length of the light path from the original to the photoreceptor requires an exposure optical system which occupies a large space relative to the length of the original. Thus the copier becomes inevitably large.

Further when employing a system of the foregoing type, it is generally difficult to provide copiers capable of copying documents of a large size, for example, those measuring 11 × 14 inches or 14 × 17 inches and to make copies with a clear image.

SUMMARY OF THE INVENTION

An object of this invention is to provide a copier which is extremely compact relative to the size of the original document and is therefore usable on the table even when copying a document of a large size and which is capable of making copies with a clear image.

Another object of this invention is to provide a copier capable of making a great number of copies from an original document rapidly and successively.

Another object of this invention is to provide an efficient copier in which the operations of forming the image and making the copy are carried out systematically so as to eliminate unnecessary operations when a trouble such as clogging with paper takes place during paper feeding operation.

Another object of this invention is to provide a copier which employs a photoreceptor made of a flexible material and supported on an endless support so that the photoreceptor alone can be replaced when the photoreceptor gets deteriorated.

Another object of this invention is to provide a device by which the paper electrostatically fitting to the photoreceptor for the transference of the image can be peeled off the surface of the photoreceptor smoothly and easily.

Still another object of this invention is to provide a device by which the image of the original transferred onto the paper can be heat-fixed rapidly with a maximum thermal efficiency without causing over-heating around the device.

In accordance with a first feature of this invention, there are provided a first carriage and a second carriage under a flat transparent document table fixed to the top of a copier, the first carriage being equipped with a document illuminating system and a plane mirror, the second carriage carrying one or a plurality of plane mirrors. These carriages are respectively mounted on guide rails parallel to the document table and the first carriage is placed on rollers rotatably attached to the second carriage and adapted to roll on the rails supporting the second carriage. One of the carriages is connected to a drive mechanism for a photoreceptor support. The first and second carriages are moved at speeds proportional to that of the photoreceptor and are in such relation that the second carriage travels at half the speed of the first carriage. To project the image of the original there is provided a lens in the path of the rays reflected by the plane mirrors on both the carriages. The projector for projecting the image of the original document of the slit type thus constructed occupies a markedly reduced space, ensures travel of the carriages at a given speed ratio, and gives clear copies.

In accordance with a second feature of this invention, a wheel for driving the first carriage having an outer peripheral length equal to the entire periphery of the photoreceptor support in an endless form is connected by way of a clutch to the drive mechanism for the support so as to be rotated at the same peripheral speed as the support, and the first carriage is connected to the wheel by separate pulling strip members such as belts which extend from the outer periphery of the wheel in opposite directions. The wheel is rotatably mounted on a stationary shaft, with a spiral spring interconnecting the wheel and the shaft, the arrangement being such that, when the clutch is engaged, the first carriage is travelled forward in operative relation to the photoreceptor support while the spring being wound up. During this movement, the second carriage follows the first carriage at half the speed of the latter. When both the carriages have completed forward travel, the clutch is disengaged whereupon the first carriage returns under the action of the wound-up spring, accompanied by the second carriage during the backward travel.

Further it is possible to provide a wheel for driving the second carriage which has an outer peripheral length half the length of the entire periphery of the photoreceptor support and which is connected, through a reduction gear and a clutch, to the support so as to be driven at half the peripheral speed of the support, the wheel being connected to the second carriage by separate belts extending from the wheel in opposite directions.

In this way, it is assured that both the carriages will be travelled forward in a given synchronized relation to the moving speed of the photoreceptor support, while the rapid backward travel of the carriages effected by the spiral spring ensures high speed copying operation.

In accordance with a third feature of this invention, an endless support for the photoreceptor has a length suitably greater than the entire length of the photoreceptor to be provided around the surface thereof. For example, for documents having miximum dimensions of 14 × 17 inches, the support may be about 560 mm in its entire peripheral length. Further the photoreceptor support is controlled by a program circuit including switches for initiating various operations in the image forming and copying process which are opened and closed by one or plurality of cams or a control member to be driven in a given relation to the support in synchronism therewith. Thus disposed around the cam or the control member are a switch for operating charging means, switch for operating an exposure optical system of the slit scanning type, switch for operating developing means, switch for initiating transport of paper and switch for operating transfer means. When a single copy is to be made, a start switch is depressed to effect charging of the photoreceptor, exposure, development, feed of paper, transfer of the image (and separation) in succession during the first one cycle of operation of the photoreceptor support. The photoreceptor support thereafter performs another cycle of operation for separation and transport of the paper and cleaning of the photoreceptor and is brought to a halt at a given starting position.

On the other hand, when a plurality of copies are to be made in succession, the start switch is depressed to effect, during the first cycle of operation, the same image forming and copying operation as in making a single copy. During each of the subsequent cycles of operation, separation and transport of the paper and cleaning of the photoreceptor for the preceding sheet of paper as well as the image forming and copy operation for the next sheet of paper are performed continually. Upon completion of the final image forming and copying operation, the photoreceptor support conducts another cycle of operation, during which the separation and transport for the last copy and cleaning of the photoreceptor are performed and the support is then stopped at the predetermined position.

Thus, the program circuit enables the copier to perform the steps of image forming and copying operation systematically, rapidly and efficiently and contributes a great deal in providing a compactor copier than conventional devices.

In accordance with another feature of this invention, a flexible photoreceptor having approximately the same size as the document to be copied is detachably provided on an endless support so that the photoreceptor, when deteriorated, can be replaced, the support thereby being rendered serviceable for a prolonged period of use.

In accordance with another feature of this invention, there is provided between the paper feeding position and image transferring position an abutting plate (stopper lugs) for temporarily interrupting the transport of paper in the path thereof. Further just in front of the abutting plate there is disposed a detecting switch to be actuated by the leading edge of the paper and incorporated in the program circuit. The switch serves as a safety device in that insofar as the switch does not function, the photoreceptor support or the switches for initiating the image forming and copying operation will not be operated. This serves to prevent troubles such as incorrect positioning of paper and clogging with paper, to systematically effect various steps of image forming and copying operation and to stop such operation when a trouble occurs during paper feeding operation.

In accordance with another feature of this invention, paper loading means is provided in a magazine which is separate from the copier and which can be detachably mounted on the copier as desired, this also rendering the copier compact.

In accordance with another feature of this invention, there is provided a paper peeling device by which the paper electrostatically attracted to the photo-receptor during transfer operation can be peeled off the photoreceptor readily.

An embodiment of such device includes a recess formed in a suitable portion of the photoreceptor support and extending in the direction of the generating line thereof in combination with an air duct for injecting air into the recess. The timing of operation of the abutting plate of the paper feed means is so determined that the leading edge of the paper will project slightly over the recess.

Another embodiment of the paper peeling device includes air injection apertures formed at a portion of the photoreceptor support where the leading edge of the paper is to be positioned. Air supplied by a duct is discharged from the apertures to peel off the front edge of the paper. At a suitable position near the photoreceptor support, another blast duct is provided from which air is forced into a clearance between the photoreceptor and peeled-off edge of the paper to continuously separate the paper from the photoreceptor.

Still another embodiment of the paper peeling device includes a suction disk for attracting the leading edge of paper so as to remove the paper when desired. The paper whose leading edge has been peeled off is further progressively peeled off the photoreceptor with a blast supplied from a blast duct positioned near the photoreceptor support.

The peeling devices described above require only a small amount of air with a low pressure, so that the fan to be used for the devices may be a sirocco fan of simple construction.

In the case where an endless belt is used for the support of the photoreceptor, the support may be bent at an acute angle about a guide roller of a small diameter. This provides another mode of peeling means THe inherent rigidity of the paper will then overcome the electrostatic attraction of the photoreceptor at the bent portion, permiting the paper to be peeled off automatically.

The paper peeled off by the devices described above is immediately delivered onto a conveyor means and sent forward for the subsequent operation.

In accordance with another feature of this invention, there is provided an air passage around the heat-fixing means for preventing the machine from over-heating which enables the heat-fixing means to effect an efficient and rapid heat-fixing operation with the heat thus accumulated.

In accordance with another feature of this invention, paper suction means is provided beneath the paper conveyor means under the heat-fixing means. Due to the provision of this means, the distance between the conveyor means and the fixing means can be reduced to achieve heat-fixing operation more effectively and rapidly.

In accordance with another feature of this invention, an air drawer for cleaner means for the photoreceptor is disposed between a cleaning brush and a collector. This arrangement makes it possible to use a compact fan of small capacity such as a sirocco fan for the air drawer and to thereby provide a compact cleaner.

Other objects and features of the present invention will become more apparent from the detailed description of the embodiments of this invention to follow.

DESCRIPTION OF THE PREFERRED EMBODIMENTS

Figure 1:
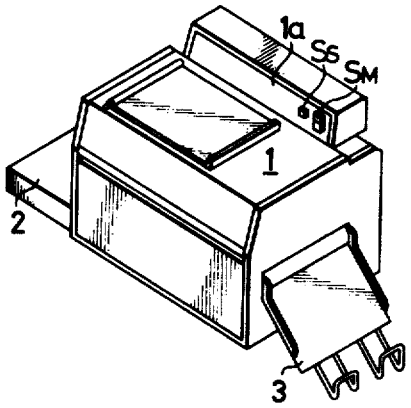
FIG. 1 is a perspective view of an electrophotographic copier of the transfer type embodying the present invention.

Referring to FIG. 1, there is shown the frame 1 of a copier, the panel 1*a* of which is provided with a main switch $S_M$ and a start switch $S_S$. The frame has a detachable magazine 2 for containing transfer paper at its one side and a copy receiver at the other side thereof.

Figure 2:
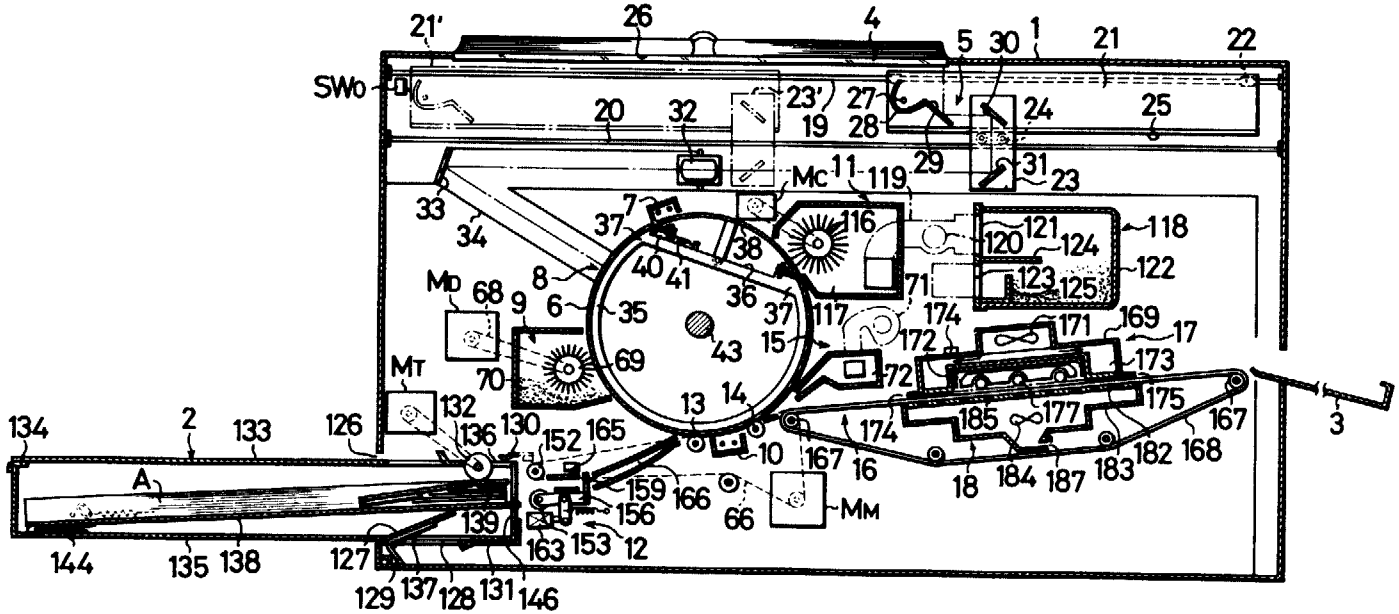
FIG. 2 is a side elevation showing the principal parts of the copier of the present invention, the view being a longitudinal section taken along the path of travel of paper.

FIG. 2, a vertical section taken along the direction of travel of the paper, shows the principal mechanisms within the frame. At the top of the frame 1 a document table 4 made of a transparent plate such as a glass plate is fixedly mounted. Disposed under the table 4 is a projector 5 of the slit scanning type for projecting the image of an original document on a photo-receptor 6 on the surface of which the image of the original is to be produced. Disposed around the photoreceptor 6 are charging means 7 such as a corona discharger, an exposure window 8 for projecting the image of the original from the projector 5 onto the surface of the photoreceptor 6, developing means 9 for supplying powder of toner to the surface of the photoreceptor to visualize the latent image of the original produced when the photoreceptor 6 is exposed, transfer means 10 comprising a corona discharger or the like for transferring the latent image onto a sheet of paper, and cleaner means 11 for cleaning the surface of the photoreceptor after transference.

On the other hand, disposed in series with the magazine 2 are paper feed means 12 for sending out paper from the magazine, interrupting the travel of the paper during transport and forwarding the paper to the transfer means 10 in a synchronism with the operation of the photoreceptor 6, guide rollers 13, 14 for bringing the paper into fitting contact with the surface of the photoreceptor 6 at the transfer station 10, peeling means 15 for removing the paper from the surface of the photoreceptor to which it has been attracted electrostatically upon passage through the transfer means 10, conveyor means 16 for carrying the paper to a heat-fixing station and further toward the copy receiver 3, heat-fixing means 17 disposed in the path of the conveyor means 16 for heat-fixing the image of the original on the copy paper, and suction means 18 disposed under the heat-fixing means 17 with the conveyor means 16 interposed therebetween.

I. Construction of the Projector

Referring to FIG. 2, a pair of guide rails 19 and another pair of guide rails 20 positioned under the glass plate 4 serving as a document table are fixed to the frame 1, the guide faces of the rails 19 and 20 being parallel to the glass plate 4.

A first carriage 21 is slidably mounted on the guide rails 19 by means of sleeves 22, and friction rollers 24 fixed to a second carriage 23 are mounted on the guide rails 20, the guide rails 20 thus guiding the movement of the second carriage 23. The first carriage 21 is mounted on the friction rollers 24 so that friction guides 25 on the bottom of the support 21 come into contact with the friction rollers 24 without slippage, the arrangement being such that the first carriage 21 and the second carriage 23 moves in the direction in synchronism at a constant speed ratio of 1½.

Figure 3:
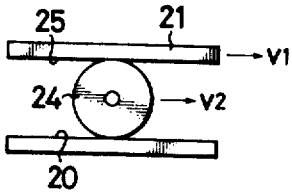
FIGS. 3 and 4 are views respectively illustrating the principle of travel of a first carriage and a second carriage.
Figure 4:
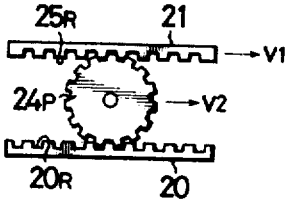

The principle of the above-mentioned movement is that, as shown in FIG. 3, when the first carriage 21 moves at a speed of $v_1$, the friction rollers 24 roll on the guide rails 20, with the result that the second carriage 23 with the friction rollers 24 moves at a speed of $v_2$ half the speed $v_1$. The present invention applies this principle to the first and second carriages.

The foregoing structure may alternatively comprise racks 25R and 20R formed in the lower face of the first carriage 21 and in the upper face of the guide rail 20 and a pinion 24P in place of the roller, whereby the same result as above will be achieved.

The first carriage 21 carries a document illuminating system and a mirror 29, the illuminating system comprising a light source 27 for illuminating the surface to be copied of the original document 26 and a reflector 28 for directing the illuminating light to the face of the original to be copied. The mirror 29 serves to reflect the projected light from the original at a right angle. The second carriage 23 is provided with two mirrors 30 and 31 for turning 180 degrees the rays from the original reflected by the mirror 29.

A projecting lens 32 is mounted at such position that the rays from the original and reflected by the mirror 31 coincide with the optical axis of the lens. A stationary mirror 33 is located at such position that the rays coming from the original and passing through the lens 32 will strike the face of the photoreceptor 6 at a right angle therewith and that the length of the light path from the original 26 to the lens 32 and that of the light path from the lens 32 to the face of the photoreceptor 6 are equal. Disposed along the light path from the lens 32 to the photoreceptor 6 is a shield plate 34.

Figure 5:
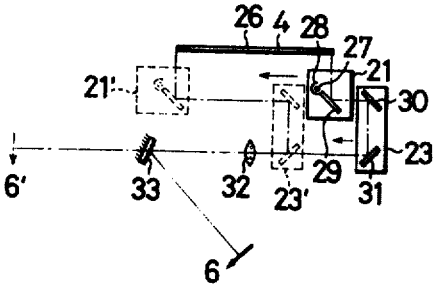
FIG. 5 is a diagram illustrating the principle and construction of an exposure optical system of the slit scanning type in accordance with the present invention.
Figure 22:
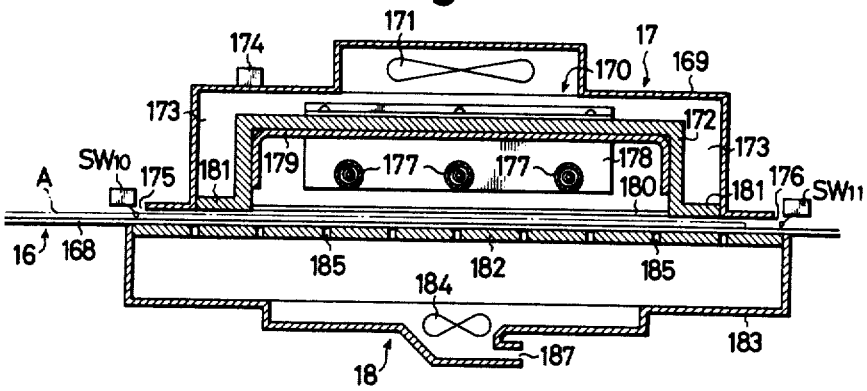
FIG. 22 is a side elevation in longitudinal section taken along the path for transporting the paper and showing heat-fixing means and paper conveyor means positioned beneath the fixing means.

The speed ratio between the first carriage 21 and the second carriage 23 has already been described. This will further be described with reference to FIG. 5 in respect of the case wherein both carriage 21 and 23 travel from the positions indicated in FIG. 22 by solid line at 21 and 23 toward the positions 21' and 23' indicated in phantom line.

When the first carriage 21 moves in the direction of an arrow in the figure, the second 23 moves in the same direction at half the speed of the former. The carriages are of course guided by the guide rails 19 and 20 during this movement. The illuminating means 27 and 28 on the first carriage 21 illuminate the face of the original, and the image of the original is reflected on the mirror 29 toward the mirror 30. Since the displacement of the first carriage 21 is always twice that of the second carriage 21 which has started to move at the same time, the distance between the mirror 29 and the mirror 30 increases as the distance between the mirror 31 and the projecting lens 32 decreases, with the result that the length of the light path from the face of the original to the lens 32 is kept constant all the time in spite of the movement of the first and second carriages 21 and 23 for the projection of the image of the original onto the surface of the photoreceptor 6. Since the speed of travel of the first carriage 21 is in synchronism with the speed of movement of the photoreceptor 6 and since the photoreceptor 6 is charged by the charging means 7, the exposure effected in the abovementioned manner continuously produces electrostatic a latent image on the surface of the photoreceptor 6.

In the embodiment shown, the projecting lens 32 has a magnification of 1. A mirror image is formed on the surface of the photoreceptor 6 indicated by a solid arrow, so that such structure is applied to a copier of the transfer type as in the case of this invention. If the mirror 33 is eliminated, a normal image will be formed on the surface 6' of the photoreceptor. Accordingly such structure will be embodied in a copier in which the image of the original is directly formed on sensitive paper.

Figure 6:
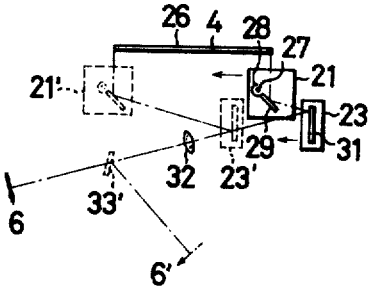
FIG. 6 is a diagram similar to FIG. 5 showing another modified embodiment.

FIG. 6 shows a construction including only one upright mirror on the second carriage 23. In this caase the length of the light path from the surface of the original to the lens 32 can also be kept constant all the time despite the movement of the first and second carriages 21 and 23 at the aforementioned speed ratio. If the mirror 33' is eliminated in this construction, a mirror image will be formed on the surface of the photoreceptor 6. This construction will then be employed in a copier of the transfer type, whereas the provision of the mirror 33' will permit a normal image to be produced on the surface of the photoreceptor 6'.

Means for operating the first and second carriages 21 and 23 and the photoreceptor 6 will be described later.

II. Construction of the Photoreceptor and the Support therefore

Figure 7:
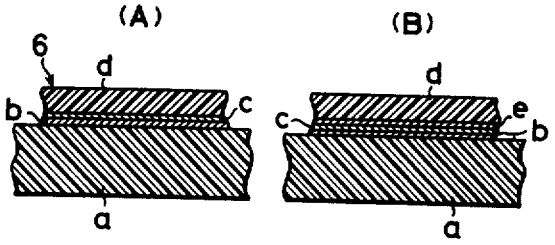
FIGS. 7A and 7B are diagrams showing the construction of flexible photoreceptors to be employed in the copier of this invention.

The photoreceptor 6 in accordance with this invention is made of a flexible sheet which comprises a laminate of a film of inorganic semi-photoconducutor formed by vacuum evaporation and a layer of organic semiphotoconductor containing a very small amount of silicone which are laid on a flexible base sheet of electrically conductive material. As shown in FIG. 7 (A), for example, the photoreceptor comprises a flexible base a having a thickness of 75 microns and image of a polyester film, a thin aluminum film *b* deposited on the base by vacuum evaporation and serving as an electrode, a very thin film *c* of amorphous selenium formed on the film *b* by vacuum evaporation (which may contain not more than 7% by weight of tellurium) and a coating *d* on the film *c* made of organic semiconductor comprising polyvinylcarbazole and a very small amount of silicone (the amount of silicone being such that it is serviceable as a binder or that it will not form a coating about several microns in thickness). The uppermost layer *d* of polyvinylcarbazole containing a very small amount of silicone serves to satisfactorily retain charges and to provide a passage for holes, while the thin selenium film *c* produces charge carriers upon absorption of the light. The aluminum film *b* forms a high rectification barrier at the boundary between the film *b* and selenium film *c* to completely prevent hole injection into the latter. When the photoreceptor is exposed with negative charges on its surface, the holes produced on the thin selenium film *c* are injected into the polyvinylcarbazole film and move to the surface to neutralize the charges on the surface to form an electrostatic latent image. Thus a useful photoreceptor capable of providing images of improved density and contrast is obtained.

Further as shown in FIG. 7 (B), a thin selenium-tellurium alloy film *e* formed by vacuum evaporation may be interposed between the polyvinylcarbazole film d and the selenium film *c*. In this arrangement, the selenium film *C* does not absorb light but merely serves to form a high rectification barrier at the boundary between the films *c* and *b* and thereby prevent hole injection. Thus it becomes possible to use about 10 to 60% by weight of tellurium in forming the selenium-tellurium alloy film *e* to thereby provide a photoreceptor having a remarkably improved sensitivity. The selenium film and the selenium-tellurium alloy film in these photoreceptors have a thickness of not more than 1 micron and the polyvinylcarbazole film is made of a high molecular weight material. The aluminum film and selenium film are adhered to each other firmly by exposing the aluminum film to glow discharge, forcibly oxidizing the same by an ion impact and then depositing selenium thereon by vacuum evaporation. For these reasons, the selenium film will not be peeled off the aluminum film even when the photoreceptor is used in the form of a belt which is passed around two rollers having a diameter of 30 mm and driven at a speed of lm/sec for 1,000 hours without interruption. In fact, the present photoreceptor is very useful even when used in the form of a belt, has high mechanical strength and excellent flexibility, can be charged to a potential as high as 1,000 volts. The photoreceptor has such high sensitivity that exposure to the image of an original can be effected at several lux. sec. In addition, the photoreceptor permits very low pre-exposure effect and is capable of forming electrostatic latent image having high contrast and resolution and serviceable for repeated use with good results.

The photoreceptor to be used in accordance with this invention is limited to those of the foregoing construction but also employable are flexible photoreceptors of the prior art made of a zinc oxide-resin dispersion.

A support for the photoreceptor 6 comprises a drum 35 of which the circular peripheral portion includes a flat portion 36 serving as a mounting for the photoreceptor 37. The flat portion 36 is provided with a cover 38 having a smaller redius of its curvature than the radius defining the periphery of the drum 35 and disposed substantially along the circumference defining the periphery of the drum 35. The cover 38 serves to eliminate troubles to be caused to the portions where the photoreceptor is fixed to the drum 35, namely the deterioration of the material resulting from ion discharges during charging operation, smudging due to invasion of carrier and toner at the developing station, or damage caused by a cleaner brush.

The circumferential length of circular face of the drum 35 on which the photoreceptor is positioned is approximately equal to the length of the document table, namely the glass plate 4. (In the case where the maximum dimentions of the original document are 14 × 17 inches, the circumferential length of the drum is about 420 mm and the entire periphery of the drum including the outer periphery of the cover is about 560 mm.)

Figure 8:
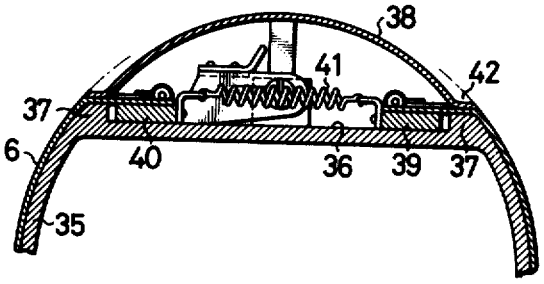
FIG. 8 is a view showing the construction of a mounting for securing the flexible photoreceptor to a drum-like support therefor.

FIG. 8 shows the photoreceptor 6 as it is mounted on the drum 35. One end of the photoreceptor 6 is secured to a chuck 39 on the mounting 37 and the other end is secured to another chuck 40, with a spring 41 provided between the chucks 39 and 40 to tension the photoreceptor 6 and thereby fit the photoreceptor 6 tightly to the peripheral surface of the drum 35. Although these chucks 39 and 40 are slidably mounted on the flat portion 36, it will be seen from FIG. 2 that one end of the photoreceptor 6 may be directly secured to the mounting 37, with the other end secured to a chuck and tensioned by a spring. Thus, the photoreceptor 6, when deteriorated due to a long use, can be replaced with a new one.

As shown in FIG. 8, the cover 38 is smaller in the radius defining the curvature than the drum 35. Thus when secured to the drum 35, the cover 38 forms at its end a recess 42 inwardly of the peripheral face of the drum 35. The recess 42 extends from one end of the drum 35 to the other end thereof along the direction of its generating line and aids in peeling off the paper as will be described later.

The drum 35 may not be limited to the one described above in respect of its shape and construction, but may be of any shape described with reference to the embodiments to be given later. Further the photoreceptor 6 may alternatively be mounted on a support in the form of a belt as will be described with reference to FIG. 26.

III. Mechanism for Interlocking Photoreceptor Support and Image Projector

Figure 9:
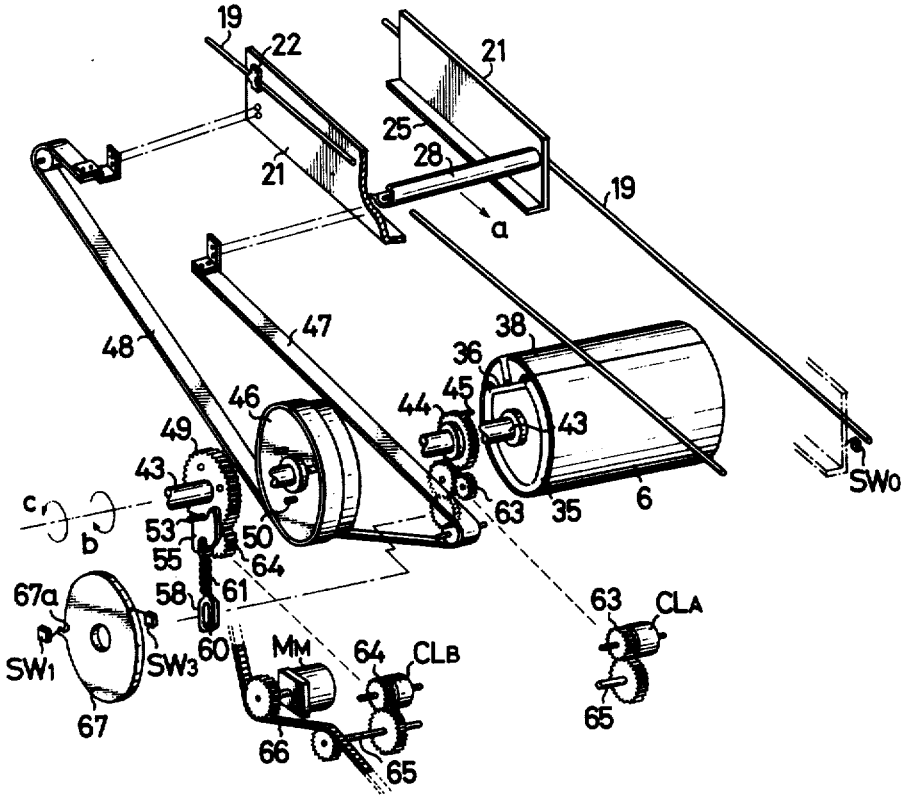
FIG. 9 is a view showing the operative relation between the photoreceptor support and the first or second carriage as the parts as seen from behind FIG. 2.

Referring to FIG. 9, the drum 35 carrying the flexible photoreceptor 6 is rotatably mounted on a stationary shaft 43 within the frame and connected to a drive gear 44 on the same shaft 43 by a pin 45 so as to rotate integrally therewith. A scanning wheel 46 having the same diameter as the support 6 is mounted on the stationary shaft 43 and provided with a belt 47 to be driven in a normal direction and another belt 48 to be driven in a reverse direction which are disposed side by side. One end of each of the belts 47 and 48 is fixed to the outer peripheral surface of the wheel 46 and the belts are adapted to be wound on the wheel 46 in directions opposite to each other. The other end of each of the belts 47 and 48 is joined to the first carriage 21. The scanning wheel 46 is connected to a drive gear 49 on the stationary shaft 43 by pins 50 or the like for rotation with the gear 49.

Figure 12:
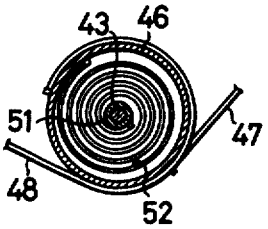
FIG. 12 is a view showing the construction of drive means for returning the first carriage or the second carriage.

As shown in FIG. 12 the scanning wheel 46 has a spiral spring 52 for returning the carriage having one end fixed to the inner surface of the wheel 46 and the other end fixed to sleeve 51 which is adapted to be fixed to a suitable portion, in the circumferential direction, of the stationary shaft 43. The spring 52 is wound up by the rotation of the wheel 46 in a normal direction.

To provide means for absorbing shock at the time when the carriage is returned, the drive gear 49 has a pin 53 and a rotary plate 55 formed with a recessed portion 54 for engagement with the pin 53 and pivoted to the frame 1 at 56. Further pivoted at 59 to the rotary plate 55 is the end of an arm 58 on a support pin 57 fixed to the frame 1, the support pin 57 being spaced from the pivot 56 by a suitable distance. The arm 58 has at its base end a slot 60 in which the pin 57 engages, and a spring 61 acting on the pin 57 and the arm 58 urges the rotary plate 55 in a counter-clockwise direction in the drawing (see FIGS. 9 to 11). Indicated at 62 is a stopper for the rotary plate 55.

The drive gears 44 and 49 are supplied with torque from a drive shaft 65 through gear systems 63 and 64, and electromagnetic clutches $CL_A$ and $CL_B$ effects or interrupts the supply of the torque. The drive shaft 65 is associated with a main motor $M_M$ by way of a sprocket transmission system 66.

The clutch $CL_A$ is operated by the start switch $S_S$ on the operation panel 1a of the copier to delivery the torque of the drive shaft 65 to the drive gear 44 through the gear system 63 and thereby rotates the drum 35. The clutch $CL_A$ is disengaged by a microswitch $SW_1$ which is operated by the control cam 67 of various image reproducing copying devices to be described later. The cam 67 is coupled to the drum 35.

The clutch $CL_B$ is actuated by a microswitch $SW_3$ to be operated by the control cam 67 and delivers the torque of the drive shaft 65 to the drive gear 49 through the gear system 64 and thereby rotates the scanning wheel 46 in a normal direction. The clutch $CL_B$ is disengaged by the operation of a return switch $SW_O$ mounted at a position where the forward travel (in the direction of an arrow a in FIG. 9) of the first carriage 21 terminates.

Thus the depression of the start switch $S_S$ rotates the drum 35 in the (normal) direction indicated by an arrow *b* in FIG. 9 and the microswitch $SW_3$ then operates to rotate the scanning wheel 46 in the same direction and at the same peripheral speed as the drum 35 to wind up the belt 47 and thereby draw the first carriage 21 in the direction of the arrow a in the figure for the scanning of surface of the original document. The image of the original document is therefor projected on the photoreceptor 6 on the drum 35. During this movement, the spiral spring 52 within the wheel 46 is wound up.

The forward travel of the first carriage 21 is followed by the movement of the second carriage 23 at half the speed of the former. When both the carriages 21 and 23 reach the terminal position of the forward travel, the first carriage 21 actuates the return switch $SW_O$ to disengage the clutch $CL_B$, whereupon the scanning wheel 46 is rapidly rotated in the (reverse) direction indicated by the arrow c under the restoring action of the spiral spring 52, winding up the belt 48 to return both the carriages 21 and 23.

Figure 10:
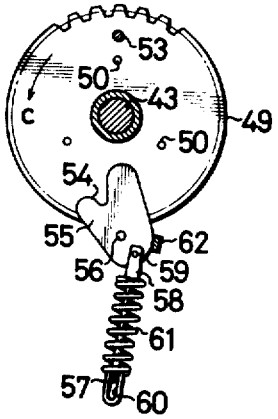
FIGS. 10 and 11 are views showing the construction and operation of shock absorbing means as the first carriage comes to a halt during its return travel.
Figure 11:
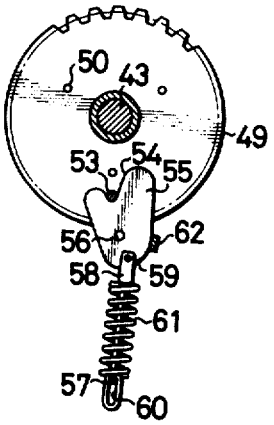

In order stop the carriages smoothly upon termination of the return movement, the shock absorbing means acts on the scanning wheel 46 through the drive gear 49 as already described. With reference to FIG. 10 showing the shock absorbing means, the pin 53 moves out of the recess 54 of the rotary plate 55 when the drive gear 49 is initiated into rotation in a normal direction, whereupon the rotary plate 55 is driven in a counterclockwise direction about the pivot 56 and remains inclined under the action of the stopper 62 and the spring 61. Accordingly, during the rotation of the drive gear 49 in the reverse direction, the recess 54 is positioned in the path of the pin 53 and is ready to receive the pin 53. Consequently, when the drive gear 49 is urged toward the direction of the arrow c by the rapid return movement of the carriages 21 and 23, the pin 53 is urged into engagement with the recess 54, thereby rotating the rotary plate 55 in a clockwise direction against the action of the spring 61 as seen in FIG. 11. The resilient action of the spring 61 therefore absorbs the impact of return movement of the carriages to bring the same to a halt.

The same result will be obtained if the shock absorbing means is so provided as to directly act on the scanning wheel 46.

The nearer the support pin 57 supporting the arm 58 to the pivot 56, the smaller will be the force required for disengaging the pin 53 from the recess 54 during the rotation of the drive gear in a normal direction and the greater will be the resilient force for absorbing the returning force of the scanning wheel 46, whereby the carriages 21 and 23 can be brought to a halt smoothly.

The restoring force of the spiral spring 52 acting on the scanning wheel 46 may be controlled as desired by shifting the sleeve 51 in the circumferential direction as it is secured to the stationary shaft 43.

Even after the completion of rotation of the scanning wheel 46, the drum 35 rotates to make a required number of turns of rotation (i.e. two turns if a single copy is to be made, the number of the turn being the desired number of the copies plus one, if many copies are to be made in succession), whereupon the control cam 67 actuates the microswitch $SW_1$, which in turn disengages the clutch $CL_A$ to stop the drum.

IV. Construction of Image Forming and Copying Assembly

As shown in FIG. 2, disposed around the support or drum 35 equipped with the flexible photoreceptor 6 are charging means 7 comprising a corona discharger; developing means of the dry type such as a developing device 9 including a magnetic roller 69 magnetized as a specific magnetic pole and to be driven by a motor $M_D$ by means of a belt 68 and a magnetic brush, the device containing a powder mixture of iron powder carrier and toner to be supplied to the photoreceptor 6; transfer means 10 comprising a corona discharger; guide rollers 13 and 14 for guiding and pressing the paper disposed on the both sides of the transfer means 10 and driven in contact with the photoreceptor 6; peeling means 15 comprising, for example, a sirocco fan 71 and an air duct 72 for removing the paper from the surface of the photoreceptor 6 after it has passed through the transfer means 10; and cleaner means 11 for removing toner remaining on the surface of the photoreceptor 6 from which the paper has been peeled off.

As already known, the charging means 7 charges the photoreceptor 6 by corona discharge. The developing means 9 supplies carrier and toner to the photoreceptor 6 on which the image of the original is projected through the exposure window 8 and electrostatic latent image is thereby formed, whereby the latent image is visualized. The guide rollers 13 and 14 press the transfer paper from the paper supply station against the surface of photoreceptor formed with the visualized image and guide the same for transport. The transfer means 10 transfers the image of the original on the photoreceptor 6 onto the paper.

Figure 13:
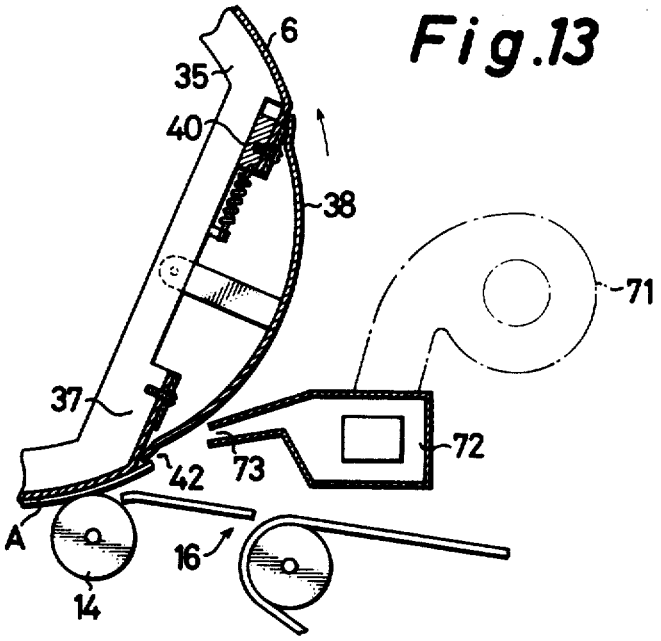
FIG. 13 is a view showing an embodiment of means for peeling off paper from the photoreceptor to which it is electrostatically stuck.

Referring to FIG. 13 showing the peeling means 15, the air injection slit 73 of the air duct 72 is directed to the peripheral surface of the photoreceptor 6 along its generating line so as to force the air from a blower such as the sirocco fan 71 to the peripheral surface of the photoreceptor 6 substantially in the tangential direction.

The paper A, with its leading and positioned at the recess 42 formed by the cover 38, is guided by the guide rollers 13 and 14 and advanced in snug-fit contact with the peripheral surface of the photoreceptor 6 as the photoreceptor 6 rotates. Since the air is forced into the recess 42 formed along the cover 38, the paper whose leading end is positioned at the recess 42 is readily peeled off the photoreceptor 6 at its leading end. As the drum 35 further rotates, air is forced into a V-shaped clearance formed between the photoreceptor 6 and the paper A with its leading end peeled off. Thus the paper becomes progressively peeled off and is then delivered onto the conveyor means 16.

Peeling of the paper thus effected with extreme ease and smoothness requires much smaller amount of air with lower pressure as compaired with conventional devices. Accordingly a very simple and compact sirocco fan will serve the purpose satisfactorily.

Although the paper is electrostatically attracted to the surface of the photoreceptor 6, the conductive cover 38 with the recess 42 free of charging will not cause the leading edge of the paper to bend into the recess 42. Even in the case where the cover 38 is made of synthetic resin or the like and is therefore charged on its surface, the leading end of the paper, with its own strength, will not be bent by attraction, since the leading end of the paper is projected over the recess 42 only 3 or 5 mm. It is therefore assured that the air will be forced into the recess 42 underneath the front edge of the paper.

The peeling means may further be somewhat modified as shown in FIGS. 14, 16, 17 and 18, whereby equivalent or greater efficiency will be achieved for peeling operation.

Figure 14:
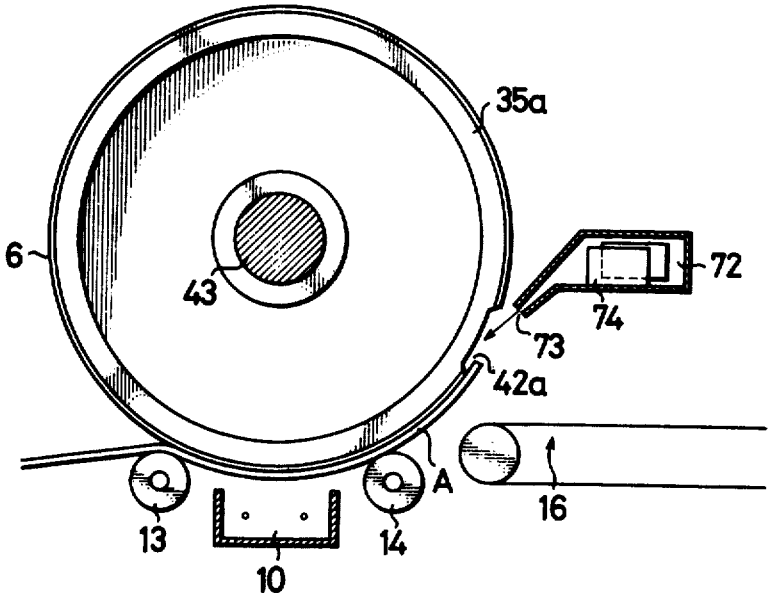
FIG. 14 is a view showing another embodiment of the peeling means.

FIG. 14 shows a drum 35a formed in its peripheral surface with a groove 42a extending along the generating line thereof to thereby provide an identical effect with the recess 42 shown in FIG. 13. The air from the duct 72 is injected into the groove **42*a*. The drum 35*a* is of course equipped with the photoreceptor 6 on its periphery, with the groove 42*a* left uncovered with the photoreceptor 6. Exactly the same action takes place in this portion as with the embodiment of FIG. 13. The shape of the groove 42*a*** may not be limited to that shown in the drawing but may be of any suitable shape.

Figure 15:
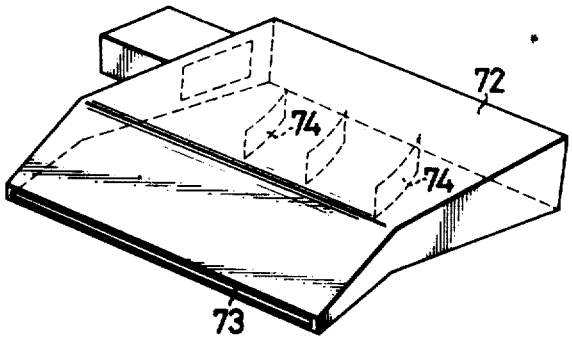
FIG. 15 is a view showing an air duct for the peeling means.

The air duct to be used in the embodiments of FIGS. 13 and 14 may have an elongated slit 73 at its front end as illustrated in FIG. 15 and include a suitable member of blades 74 disposed within the duct for uniform discharge of air from the slit 73.

Figure 16:
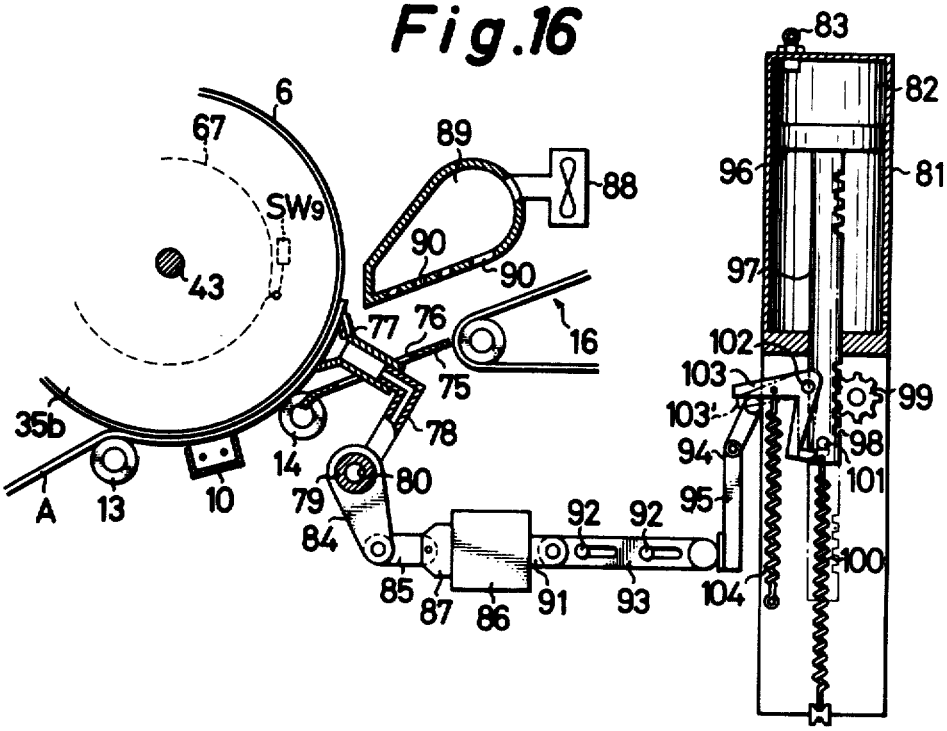
FIG. 16 is a view showing another embodiment of the peeling means.

Another embodiment of the peeling means shown in FIG. 16 includes a guide plate 75 for conducting the paper A from the guide roller 14 to the conveyor means 16. The guide plate 75 is formed at a suitable portion with a window 76 having such size that a flaring suction disk 77 can be retracted or extended through the window.

The suction disk 77 is joined with the front end of a bent nozzle 78 which is secured at its base end to a duct 79 rotatably supported on an unillustrated bracket within the frame 1, the arrangement being such that the rotation of the duct 79 moves the suction disk 77 through the window 76 upwardly or downwardly of the guide plate 75. The nozzle 78 communicates with the inner passage of the duct 78. A suitable number of nozzles 78, each equipped with a suction disk 77, may be mounted on the duct 79. The duck 79 is disposed in parallel with the generating line of the drum **35*b*, and the inner passage 80 thereof communicates with an air chamber 82 of a cylinder 81 by way of a pipe 83. Fixed to the duct 79 is an arm 84 whose distal end is connected by a link 85 to the actuator 87 of a solenoid 86. Accordingly, the solenoid 86, when energized, rotates the duct 79**.

Disposed above the guide plate 75 is a duct 89 for conducting air from a fan 88. The duct 89 has a suitable number of air injection holes 90 or slits in its under face.

In the rear of the solenoid 86, there is provided another actuator 91 connected to a rod 93 whose movement is guided by pins 92. The tail end of the rod 93 is engaged with the driven portion of an actuating lever 95 pivoted at 94.

The cylinder 81 includes therein a piston 96 with a piston rod 97 formed with a rack 98 meshing with a gear 99. The piston rod 97 is provided with a spring 100 for pulling the piston downward in the figure. The gear 99 is associated with unillustrated drive means by may of a clutch and is rotatable in normal and reverse directions. The piston rod 97 is further provided with a pin 101 to be engaged by the hook of a latch lever 103 pivoted at 102 so as to retain the piston rod 97 at the position where the spring 100 is tensioned. The tail end of the latch lever 103 is in engagement with the drive portion of the actuating lever 95. A spring 104 urges the latch lever 103 in a counterclockwise direction in the drawing to keep its hook in engagement with the piston rod 97.

When the leading edge of the paper A passes over the guide roller 14 and reaches the position of the suction disk 77 while the image of the original is being transferred onto the paper A, the control cam 67 rotating integrally with the drum 35b actuates a microswitch $SW_9$ to feed a signal to the solenoid 86, whereupon one of the actuators indicated at 87 is pulled to rotate the duct 79 and thereby press the suction disk 77 against the rear face of the paper A as shown. At the same time, the solenoid pushes the other actuator 91 to bring the rod 93 to the illustrated position and thereby operate the actuating lever 95, which in turn rotates the latch lever 103 to the illustrated position to release the piston rod 97. The parts are therefore brought to the position as shown.

Due to the above movement, the piston is pulled down by the spring 100 to reduce the pressure within the air chamber 82, whereby the rear face of the paper A is forcibly fitted to the suction disk 77 under the suction acting by way of the duct 80 and nozzle 78. Subsequently, the signal to the microswitch $SW_9$ is interrupted through the rotation of the control cam 67. The actuators 87 and 91 are consequently moved leftward causing the duct 79 to rotate clockwise and thereby retract the suction disk 77 downwardly through the window of the guide plate 75, permitting the paper A to lie on the guide plate 75. Simultaneously with this movement of the suction disk 77, namely with the positioning of the paper A on the guide plate 75, the electromagnetic clutch for the gear 99 is actuated to rotate the gear 99 in a clockwise direction and return the piston 96 upward, with the result that the air in the chamber 82 is compressed to eliminate the suction of the suction disk 77.

The paper A on the guide plate 75 is then delivered to the conveyor means 16 by the guide roller 14 while being subjected to a weak wind supplied through the duct 89 from the fan 88 thereabove and is sent forward for the subsequent operation. On the other hand, the piston 96 returned to an upper position is retained in this position, with the spring 100 tensioned, the pin 101 on the piston rod being engaged by the hook of the latch lever 103 as shown in a phantom line 103 in the figure.

Figure 17:
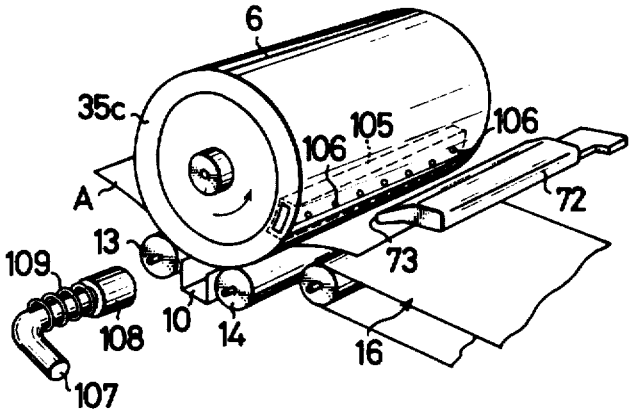
FIG. 17 is a view showing another embodiment of the peeling means.

Alternatively, the means for peeling off the paper may have a structure shown in FIG. 17. In this embodiment, a drum **35*c* is provided at a suitable portion with a duct 105 disposed along the generating line of the drum 35c. A suitable number of small apertures 106 communicating with the passage of the duct 105 are formed in the surface of the drum 35c, the apertures being arranged in a row along the generating line of the drum 35c. The duct 105 is closed at its one end and open at its other end and at the end of the drum. The contact member 108 of an air conduit 107 is hermetically in sliding contact with this opening under the action of a spring 109. (For a better understanding of such arrangement, the drawing shows the contact member and the end face of the drum in separated position.) The air conduit 107 is fixed in a given position such that the conduit supplies the air into the duct 105 when the duct 105 reaches a position where the paper A is to be peeled off. An unillustrated blower feeds a suitable amount of blast to the air conduit 107**.

When the paper A is fed to the transfer means 10 with the leading end thereof positioned on the apertures 106 of the duct 105 and reaches the position determined by the air conduit 107 after passing over the guide roller 104, the conduit 107 supplies the air into the duct 105 which air is forced out through the apertures 106, so that the paper A is peeled off the surface of the photoreceptor 6. As in the embodiments of FIGS. 13 and 14, a jet of the air from the slit 73 of the duct 72 is injected into a V-shaped clearance between the photoreceptor 6 and the paper A to force the paper off the photoreceptor onto the conveyor means 16.

Figure 18:
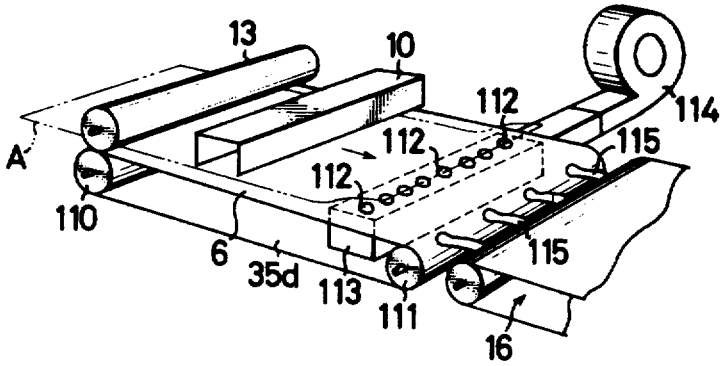
FIG. 18 is a view showing another embodiment of the peeling means.

FIG. 18 shows paper peeling means to be used for a support for photoreceptor in the form of an endless belt **35*d*. The photoreceptor 6 is mounted on the face of the support 35*d*** integrally therewith.

The support **35*d* is passed around the rollers 110 and 111 and is driven in the direction of an arrow. A guide roller 13 and transfer means 10 are disposed on the upper face of the support 35*d***.

As shown in the drawing, the support **35*d* is formed with a row of apertures 112 transversely thereof and a duct 113 is disposed inside of the support 6 with an air injecting portion up. A blower 114 supplies a blast to the duct 113. Disposed between the support 35*d* and the conveyor means 16 are a suitable number of fingers 115 whose distal ends are in proximety with the surface of the support 35*d*. The fingers 115 guide the paper A between the support 35*d* and the conveyor means 16**.

When the apertures 112 reach the position above the duct 113 as the support **35*d* moves forward, the air supplied into the duct 113 is discharged from the apertures 112 and forces up the leading edge of the transfer paper A covering the row of apertures 112. The fingers 115 then come in between the paper A and the photoreceptor 6 and remove the paper from the photoreceptor 6 as the support 35*d* moves further forward, the paper A thus being led onto the conveyor means 16**.

Each of the peeling means described above is suitable for use with the apparatus of this invention. The blower may be a sirocco fan or the like which is compact and of a small capacity. As will be apparent from the construction, each of the supports for the photoreceptor described is in an endless form and the entire length thereof is longer than the length of the photoreceptor by the length of the cover.

The cleaner means 11 comprises a brush 116 driven by a motor $M_C$ and made, for example, of rabbit hair implanted in a main body, a box 117 for receiving powdery toner removed from the surface of the photoreceptor by the brush, an air drawing pipe 119 for conducting the toner in the box 117 into a collector 118, an air drawer 120 such as a sirocco fan disposed at the inlet of the pipe 119 or intermediately thereof, and the collector 118 for receiving the powdery toner from the air drawing pipe 119. The collector 118 comprises a mounting plate 121 fixed at the outlet of the pipe 119, a bag 122 attached to the mounting plate 121 for storing the powder and a filter 123 detachably provided for an air vent at a lower portion of the mounting plate 121 for permitting only the passage of air. When desired, the collector 118 may further include an air stream guide 124 projecting into the bag 122 and a barrier 125. The air drawing pipe 119 is in the form of a flexible tube. The bag 122 may be disposed at a desired position in the frame 1 for ease of access for removal. The bag 122 may be detachably held to the mounting plate 121 and may not be of air permeability. Flexibility is not particularly needed. The material for the bag may be cloth, synthetic resin, metal or some other material. It is preferable that the bag 122 be rough-surfaced on its inner face to permit the toner powder to stick with ease. Some air permeability will help the toner surface stick to the inner surface.

The air drawer 120 when positioned closer to the box 117 will achieve more efficient air drawing action.

The remaining toner powder, when swept off the surface of the photoreceptor into the box 117, is drawn by the air drawer 120 into the bag 122 along with the air and separated from the air stream by the guide 124 and barrier 125 and deposited in the bag 122. The air stream in the bag 122 is then discharged through the filter 123. The filter 123 may be replaced after a suitable period of use.

The air drawer 120 which is positioned at the inlet of the pipe 119 or intermediately thereof, therefore in front of the mounting plate 121, not only draws the powder with high efficiency but also serves to introduce a weak air stream into the bag 122, thus ensuring separation of the powder from the air stream efficiently and thereby mitigating clogging of the filter. This further makes it possible to use a bag of an inexpensive material.

In the lower portion of the frame 1, there are disposed paper loading means including a detachable paper magazine 2 and a loading device therefore, paper feed means 12 for supplying the paper between the guide roller 13 and the photoreceptor 6, conveyor means for transporting the paper which has been peeled off the photoreceptor 6 after the transfer of image thereon, means 17 for heat-fixing the image of an original on the paper during transport, and suction means 18 for retaining the paper on the conveyor means by attracting the same thereto in proximity with heat sources while the paper passes through the heat-fixing station. These means are arranged in series, and the path of transport of the paper is approximately linear.

Figure 19:
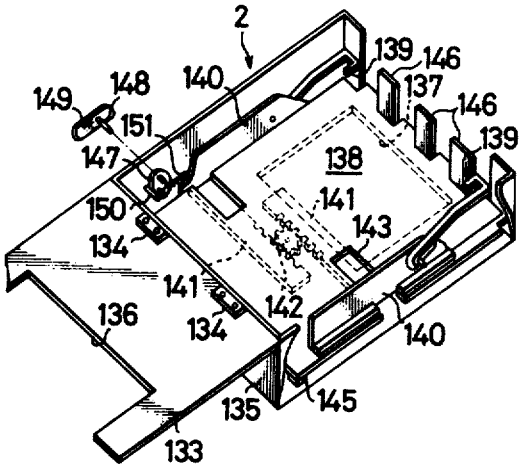
FIG. 19 is a perspective view showing an embodiment of the magazine to be used for paper loading means.
Figure 20:
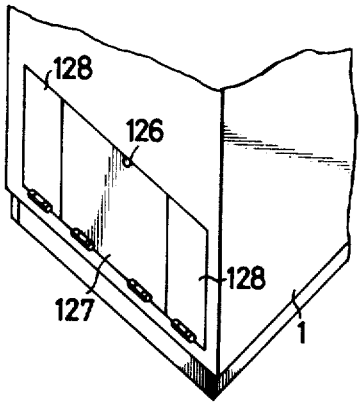
FIG. 20 is a perspective view showing part of frame of the copier where the magazine is to be inserted.

To provide the paper loading means, it will be seen from FIGS. 2, 19 and 20 that the side plate of the frame 1 is formed with a window 126 for inserting the magaxine, and a center door 127 and side doors 128 on the opposite sides of the door 127 are hingedly attached to the under edge of the window 126, with a spring 129 acting on the rear faces of the doors. Accordingly, when the magazine 2 is not inserted, the window 126 is closed as shown in FIG. 20. The side doors 128 serving as a guide for the insertion of the magazine are brought to a horizontal position when loading the magazine as seen in FIG. 2, with the distal ends thereof received by the end of a magazine guide 131.

The frame 1 includes a lock 130 for preventing upward tilting of the magazine, the above-mentioned magazine guide 131 for guiding and retaining the magazine in position, and feed roller 132 driven by a motor $M_T$ and to be in contact with the uppermost sheet of paper when the magazine is inserted.

The magazine 2 is shown in FIG. 19 in detail. An upper lid 133 hinged at 134 to a case 135 is formed with a large opening 136 for receiving the feed roller 132, while the bottom of the case 135 is formed with an opening 137 in which the center door 127 of the frame 1 engages under the action of a spring 129 as seen in FIG. 2.

The case 135 further includes a support plate 138 for receiving sheets of paper A. Disposed on the support plate 138 at its opposite sides are a pair of holders 139 for holding the front end of the paper and a pair of side plates 140 which are slidable widthwise of the paper. The side plates 140 are provided with racks 141 along the under face of the support plate 138 which are meshing with a pinion 142. The pinion 142 is rotated by an unillustrated operation portion to move the side plates 140 and holders 139 within the range defined by a groove 143 formed in the support plate 138 so as to position the side plates 140 along the opposite sides of the paper.

The support plate 138 has its one end fixed to the case 135 by a leaf spring 144 and a base member 145 and the other end thereof extending to comblike upstanding members 146 at the front end of the case 135 so that the leading ends of sheets of paper on the support plate 138 may be brought into registry by the upstanding members 146. Further as seen in FIG. 2, the support plate 138 is inclined, with its front end positioned at an elevated position.

In the case where paper of a specific size is used and there is no need to adjust the paper supply assembly to the width of paper, the upstanding members serving as a paper abutment may be disposed at the rear end of the support plate 138. In this case they need not be in the form of a comb and the slidable adjusting means for the side plates 140 can of course be eliminated.

A nail 147 provided only on one side face of the case 135 and positioned above the support plate 138 is rotated about a pin 148 manually by a lever 149. Before the magazine 2 is inserted into the frame 1, the nail 147 keeps the support plate 138 depressed to a horizontal position with its distal end and, when the magazine is loaded on the frame 1, the support plate 138 is relieved of the depression by operating the lever 149, whereby the front end of the support plate 138 is pushed upward as shown in FIG. 2 by the leaf spring 144 and the spring 137 behind the center door 127, with the result that the uppermost sheet of paper is pressed against the feed roller 132. A pin 150 retains the nail 147 as it depresses the support plate 138. A spring 151 keeps the nail 147 in disengaged position when the support plate 138 is released from the nail.

In installing the magazine 2, sheets of paper are placed thereinto in registry, and the lid 133 is closed, with the holders 139 pressing the upper face of the paper at its front end. The magazine 2 is then inserted into the window 126 of the frame 1, whereby the magazine 2 is guided by the side doors 128 with the front end thereof brought into engagement with the lock 130 and the magazine guide 131. The center door 127 projects into the magazine through the opening 137, permitting the front edge of the door 127 to come into resilient contact with the under face of the support plate 138. On the other hand, the feed roller 132 gets into the front upper portion of the magazine 2. In this state the nail 147 is turned by the lever 149 to free the support plate 138 from depression, whereupon the plate 138 is pushed up by the springs 144 and 129 to permit the uppermost sheet of paper to contact the feed roller 132. The feed roller 132 will then be driven by the motor $M_T$. The holders 139 arresting the front end of the paper assures that the paper will be sent out one sheet after another. Every time a sheeet of the paper is sent out, the support plate 138 is gradually pushed upward by the springs 144 and 129, thereby keeping the uppermost face of the paper in contact with the feed roller 132.

When the magazine 2 is to be unloaded from the frame 1 for the change of paper of a different size or supply of paper, the lever 149 is operated to depress the support plate 138 and force the center door 127 out from the interior of the magazine through the opening 137. The magazine 2 will then be pulled out.

Figure 21:
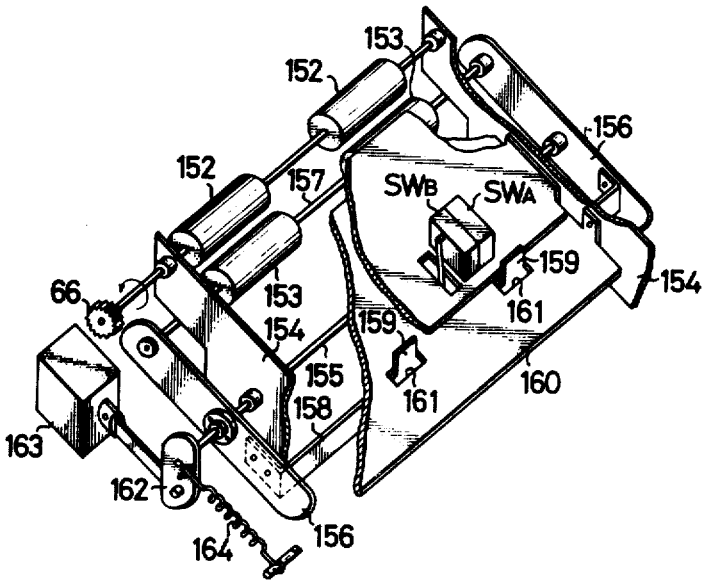
FIG. 21 is a perspective view showing the principal construction of paper feed means for temporarily stopping the paper at the feeding station.

The paper feed means 12, disposed between the loading means and the transfer means 10, has feed rollers 152 driven by a main motor $M_M$ through a sprocket transmission system 66 and driven rollers 153 in opposite relation to the feed rollers 152 as shown in FIG. 21. The driven rollers 153 are mounted on a shaft 157 at one end of each of arms 156 fixed to the opposite ends of a shaft 155 supported on brackets 154 fixed to the frame 1. The driven rollers 153 are engaged with and disengaged from the feed rollers 152 through the seesaw of the arms 156. Secured to the other end of each of the arms 156 is a stop plate 158 provided with stopper lugs 159 which are projected to or retracted from the path of travel of the paper through windows 161 formed in a lower guide plate 160 for the paper. Fixedly mounted on one end of the shaft 155 is a rotary plate 162 which is connected to a solenoid 163. Indicated at 164 is a return spring for the solenoid.

When the supply of current to the solenoid 163 is interrupted and effected, the arms 156 are brought into seesaw. Thus when the stopper lugs 159 are retracted downward from the windows 161, the driven rollers 153 contact the feed rollers 152 to transport the paper in the direction of an arrow, whereas if the lugs 159 project upward from the windows 161, the driven rollers 153 are disengaged from the feed rollers 152 to stop the transport of the paper.

Mounted on an upper guide plate 165 positioned above the lower guide plate 160 and forming the path of the paper are microswitches $SW_A$ and $SW_B$ having actuators extending to the path of the paper though the upper guide plate 165, the actuators thus being adapted to be operated by the paper at the position just in front of the stopper lugs 159.

The microswitch $SW_B$, when actuated by the leading end of the paper, disconnects the motor $M_T$ from the power source and thereby stops the feel roller 132. The switch $SW_B$ is further associated with a switch for disconnecting the solenoid 163 from the power source. The microswitch $SW_A$ is associated with means for synchronizing the paper feeding operation with the movement of the photoreceptor 6 as will be described later in greater detail.

In this way, the paper A sent out from the magazine 2 by the feed roller 132 is temporarily stopped by the stopper lugs 159 to correct the position of the paper as it is sent out. The paper feed means 12 further permits the paper to be forwarded to the photoreceptor 6 in such manner that the leading edge of the paper will be brought to the already described position relative to the front end of the photoreceptor 6. As a result, the feed means is free of accident due to clogging with paper and does not permit incorrect positioning of the paper when it is fed and during transport. When the stopper lugs 159 are retracted downward, the feed means 12 forwards the paper by way of the path 166 and feeds the same between the guide roller 13 and the photoreceptor 6.

The conveyor means 16 comprises pulleys 167 driven by the main motor $M_M$ through the sprocket transmission system 66 and an endless belt 168. The paper with the image of the original transferred thereon and removed from the photorecptor 6 by the peeling means 15 is carried on the conveyor means 16 to pass through the heat-fixing means 17 and is laid on the copy receiver 3.

The heat-fixing means 17 is shown in FIGS. 2, 22, 23 and 24 in detail. The outer case 169 of a fixing device is formed in its upper end with a window 170 above which a cooling fan 171 is disposed. A passage 173 for a cooling air is formed between the outer case 169 and an inner case 172 of a heat insulting material. The fan is not yet operated when current supply to the heat sources of the fixing device is initiated but, when the temperature within the fixing device reaches a given level, it starts to operate under the control of a thermostat 174 and supplies cooling air into the passage 173. Further when desired, microswitches $SW_{10}$ and $SW_{11}$ are disposed at an entrance 175 and exit 176 for the paper, so that when the leading end of the paper actuates the microswitch $SW_{10}$ at the entrance 175 the fan 171 is stopped, while the microswitch $SW_{11}$ at the exit, when actuated, operates the fan 171 again.

A plurality of heat sources 177 made of a nichrome wires and a quartz tube or the like are fixed at opposite ends to the inner case 172 by brackets. A reflector 179 secured to the inner face of the inner case 172 directs the whole radiant heat to the paper. A plurality of guide wires 180 disposed side by side in flaring arrangement along the direction of transport of the paper prevent warping of the paper toward the interior of the inner case.

Figure 23:
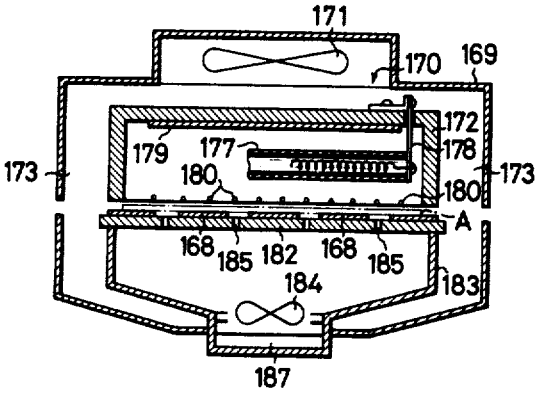
FIG. 23 is a view showing the heat-fixing means and the paper conveyor means illustrated in FIG. 22, the view being in cross section taken transversely of the path for transporting the paper.

The passage 173 for the cooling air is open at its lower portion on the opposite sides along the direction of travel of the paper as seen in FIG. 23 but is closed by bottom plates 181 at the portions to be positioned above the advancing paper, the plates 181 being integral with the inner case 172. In this way air curtains are formed at the opposite sides to direct 100% of the heat of the fixing device to the surface of the paper.

The suction means 18 positioned under the heat-fixing means 17 comprises a suction box 183 and an air discharge fan 184 disposed therein, the suction box 183 including a top plate 182 for guiding an endless belt 168 having heat resisting properties. As shown in FIG. 23, the endless belt 168 is in the form of a suitable number of strips disposed side by side. Numerous small apertures 185 are formed in the top plate 182 at the positions corresponding to the clearances between these strips. The paper A on the belt 168 can therefore be laid flat on the belt 168 in fitting contact therewith under the suction of the air discharge fan 184 against possible warping.

Figure 24:
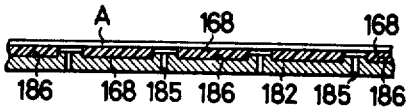
FIG. 24 is a view in cross section showing the conveyor menas positioned beneath the heat-fixing means.

In the case where the belt 168 is made for example of a thin stainless steel material or the like, the belt 168 may be adapted to move forward in sliding contact with the top plate 182. If the belt 168 is made of a thick silicone rubber material or the like, it is desired that the top plate 182 be formed with grooves 186 for guiding the belt as shown in FIG. 24 so as to position the paper clser to the perforations 185 to the greatest possible extent. The air discharged from the suction box 183 is sent out of the machine through a duct 187.

With provision of the air curtains, the heat-fixing means thus accumulates heat within the inner case 172 to achieve an improved thermal efficiency, while preventing the exterior of the outer case 169, namely the interior of the copier from overheating. Further the suction means which permits the paper to pass through the heat-fixing station perfectly in flat form eliminates clogging of the path with paper and enables the paper to be positioned in immediate proximity with the heat sources to ensure a greatly improved thermal efficiency and a rapid operation for heat-fixing. In addition, there is no need to provide the belt 168 with some means for keeping the paper in planar position.

Figure 25:
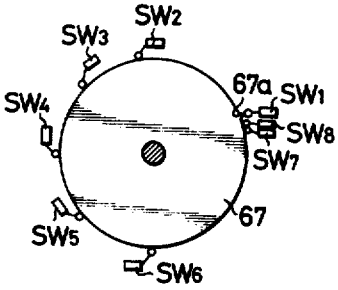
FIG. 25 is a view showing an example of a cam for opening and closing various operation switches of a program circuit in operative relation to the photoreceptor support.
Figure 27:
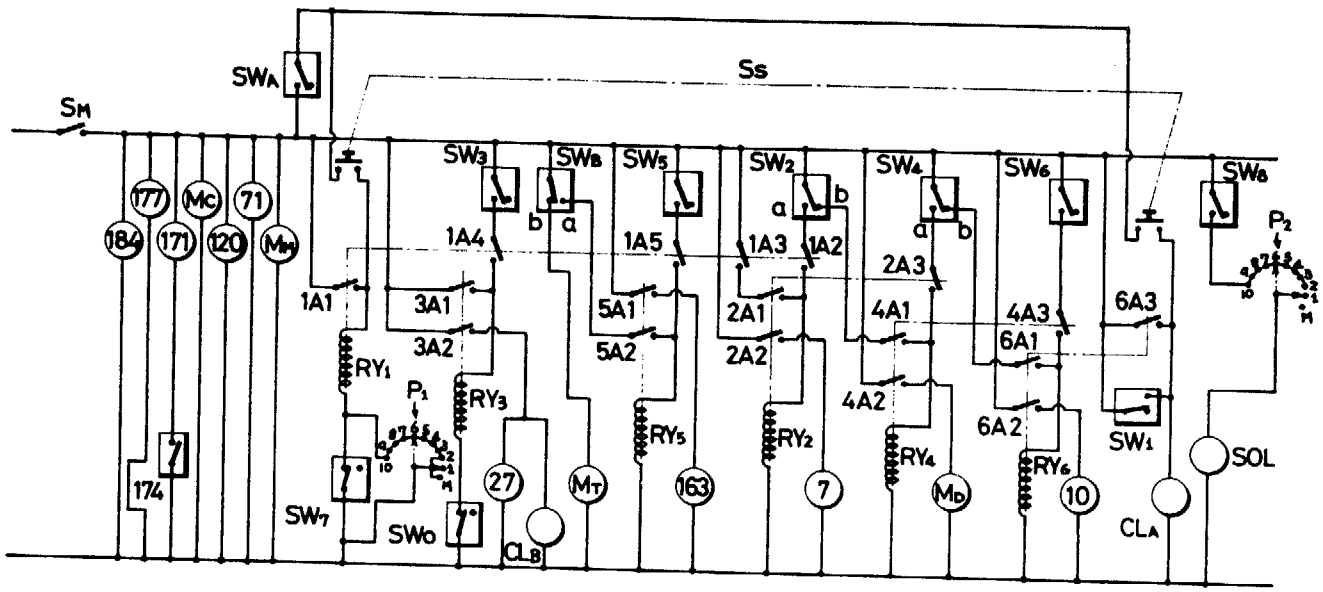
FIG. 27 is a diagram showing an example of the program circuit for controlling the image forming and copying operation.

The controll cam 67 for the various image forming copying devices already described is coupled with the photoreceptor support 35 through the gear system 63 as shown in FIG. 9, the arrangement being such that if the support for the photoreceptor is in the form of a drum, the cam is driven at the same speed, and if it is in the form of a belt, the cam is driven at a peripheral speed equal to that of the support. The cam includes on its periphery a projection **67*a* positioned in a corresponding relation to the front end of the photoreceptor and is provided, around its periphery, with microswitches for operating various means as shown in FIG. 25, the actuators of the microswitches being adapted to be operated by the projection 67*a*. These microswitches include the microswitch $SW_2$ for operating the charging means 7, microswitch $SW_3$ for operating the image projector, microswitch $SW_4$ for operating the developing means 9, microswitch $SW_5$ for operating the paper feed means, microswitch $SW_6$ for operating the transfer means 10, microswitch $SW_7$ for stopping the charging means 7, microswitch $SW_8$ for operating a known presetting counter to be described later but not shown, and microswitch $SW_1$ for detecting the front end of the photoreceptor and for stopping the support. These microswitches are connected into a circuit as illustrated in FIG. 27. When desired, a microswitch $SW_9$ may be provided between the switches $SW_6$ and $SW_7$ for energizing solenoid 86 to operate the the suction disk 77** included in the peeling means.

Alternatively, the control cam for the respective image forming and copying means may comprise a plurality of disk cams of a small diameter for actuating the switches which are driven at the same speed or at the same peripheral speed as the support for the photoreceptor.

Figure 26:
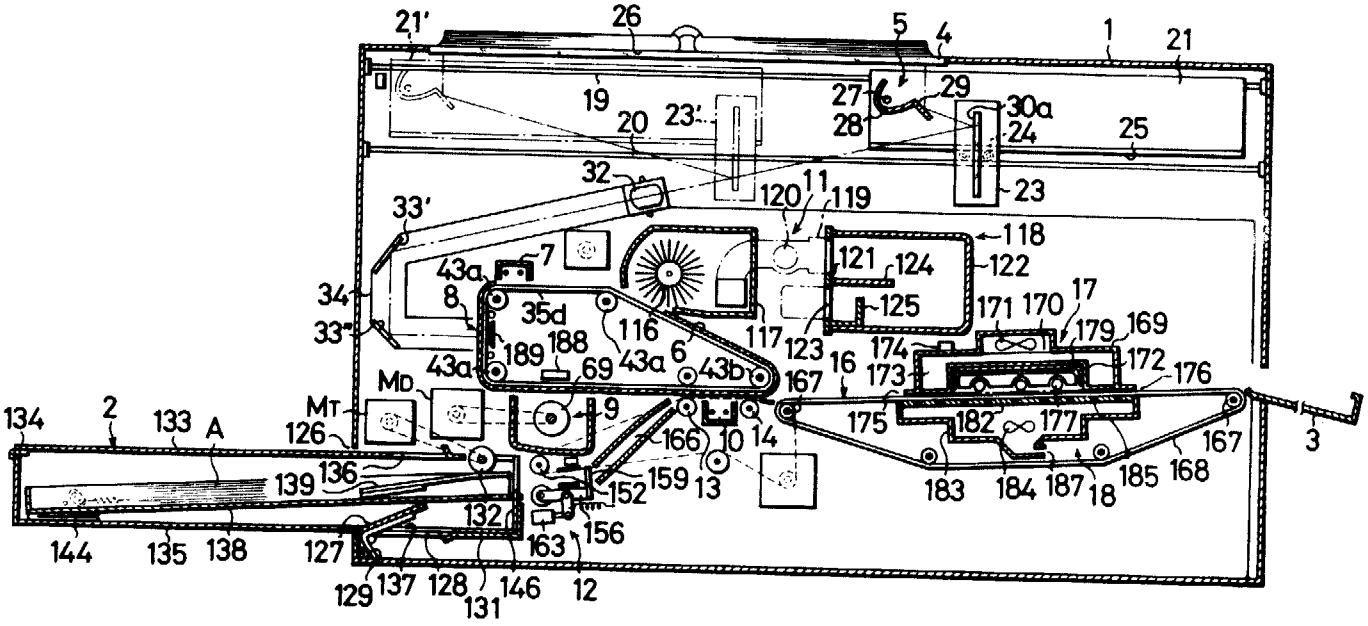
FIG. 26 is a view showing another embodiment of the copier in accordance with the present invention.

FIG. 26 shows another embodiment of this invention wherein the support for the photoreceptor is in the form of an endless belt **35*d* and the exposure optical system of the slit scanning type is based on the principle illustrated in FIG. 6. The portions corresponding to those of the embodiment 2** are referred to by the same reference numerals.

A second carriage 23 carries an upstanding mirror **30*a* in facing relation to a mirror 29 on a first carriage 21, and the image of an original document passing through a projecting lens 32 is led to the surface of a photoreceptor 6** at a right angle therewith by two mirrors 33' and 33'' to reproduce a mirror image corresponding to the image of the original on the photoreceptor 6 as in FIG. 2.

The endless belt 35*d* serving as a support for the photoreceptor 6 is made of a flexible material such as plastic film, aluminum film, stainless steel film or the like and is reeved around several rollers 43*a*. As in the embodiment in FIG. 2, a drive roller 43*b* is connected by way of a clutch $CL_A$ to a sprocket transmission system 66 of a main motor $M_M$.

The flexible photoreceptor 6 is removably or integrally mounted around the endless belt 35*d* by an adhesive tape or some other means. Disposed around the photoreceptor 6 are charging means 7, exposure window 8, developing means 9, transfer means 10, guide rollers 13 and 14, and cleaner means 11. These image forming and copying means have constructions as already described. The developing means 9 may include a magnetic roller 69 and an opposite plate 188 of a different polarity so as to form a satisfactory developing brush. At the position opposite to the exposure window 8, there is provided a known member 189 for keeping the photoreceptor 6 in a planar form. Since the support 352 for the photoreceptor 6 is turned as shown in drawing at an acute angle at a position ahead of the transfer means 10, the paper is allowed to peel off the surface of the photoreceptor due to its own rigidity. Accordingly, peeling means such as already described will be dispensed with.

Needless to say, the support for the photoreceptor is driven at such speed that it is in the already described relation with a control cam 67 and scanning wheel 46 in respect of the rotational peripheral speed.

(V) The Operation of the Copier of this Invention (with reference to FIG. 27)

Paper is placed in a predetermined position in the magazine 2, and the paper-loaded magazine 2 is then inserted into frame 1 through the window 126 to set the same in position. The support plate 138, when freed from depression, brings the paper in pressing contact with the feed roller 132. On the other hand, a document 26 is placed on the glass plate 4.

Closing of the main switch $S_M$ actuates the main motor $M_M$, fan 71 for the peeling means 15, cleaner motor $M_C$, fan for the cleaner means 120, heat sources for fixing operation, and air discharge fan 184 for the suction means. When the temperature of the fixing means exceeds a predetermined temperature, the thermostat 174 operates the cooling fan for the fixing means 17 which is repeatedly turned on and off by the operation of the thermostat 174 to keep the fixing means at a predetermined temperature for fixing operation.

The main motor $M_M$ when driven rotates the feed rollers 152, conveyor roller 167, and drive shaft 65 through the sprocket transmission system 66, but the support 35 for the photoreceptor will not be rotated, since the microswitch $SW_1$ has its contact opened by the projection 67*a* of the control cam 67 and the clutch $CL_A$ is therefore out of operation.

Simultaneously with the closing of the main switch $S_M$, the microswitch $SW_B$ is closed at a contact *b* to operate the feed motor $M_T$ and thereby drive the feed roller 132, by which the uppermost sheet of the paper in the magazine 2 is sent out to the paper feed means 12. Just before abutting the stopper lugs 159, the leading end of the paper actuates the actuators of the microswitches $SW_A$ and $SW_B$, whereupon the switch $SW_B$ is closed at a contact a to deenergize the motor $M_T$ and the paper comes to a halt upon striking the stopper lugs 159. On the other hand, the switch $SW_A$ thus closed connects the circuit of the start switch $S_S$ to the power source, rendering the switch $S_S$ ready to operate.

Accordingly, if the paper has been consumed or a trouble occurs in the transfer means, the paper feed means or the like and no paper is sent toward stopper lugs 159, the switch $SW_A$ will be left open and the depression of the start switch $S_S$ will not initiate the operation to reproduce an image for copying. In other words, the switch $SW_A$ serves as a kind of a safety device and gives a warning by way of the start switch $S_S$.

In the normal state wherein the paper is stopped upon hitting the stopper lugs 159, depression of the start switch $S_S$ energizes a relay $RY_1$ through the microswitch $SW_7$, whereby contacts 1A1, 1A2, 1A3, 1A4 and 1A5 are closed and the relay is self-maintained at the contact 1A1. At the same time, the closing of the switch $S_S$ engages the clutch $CL_A$ to deliver the torque of the main motor $M_M$ to the drive gear 44, which brings the support 35 of the photoreceptor and the control cam 67 into rotation.

Due to the rotation of the control cam 67, the projection 67*a* thereon disengages from the actuator of the microswitch $SW_1$ to close its contact and keeps the clutch $CL_A$ in operation. At this time, the depression on the start switch $S_S$ is relieved to open its contact.

The rotation of the control cam 67 further causes its projection 67*a* to operate the microswitch $SW_2$ to close the contact a thereof and thereby energize a relay $RY_2$ through the contact 1A2. The relay $RY_2$ is self-maintained by way of the contacts 1A3 and 2A1 and supplies current to the high voltage charging means 7 through the contact 2A2. The photoreceptor 6 passing immediately below the charging means 7 is therefore charged. When the projection 67*a* has passed by the microswitch $SW_2$, the switch $SW_2$ is opened at its contact a and closed at its contact *b*.

Through further rotation of the control cam 67, the projection 67*a* operates the microswitch $SW_3$, which energizes the relay $RY_3$ through the contact 1A4. The relay $RY_3$ is self-maintained at a contact 3A1 and turns on the illuminating light source 27 by way of a contact 3A2 and at the same time operates the clutch $CL_B$, which transmits the torque of the drive shaft 65 to the scanning wheel 46. As a result, the wheel rotates in a normal direction, causing the first and second carriages 21 and 23 to move at the speeds previously mentioned and to project the image of the original document 26 to the charged photoreceptor 6 which is passing by the exposure window 8 while illuminating the document 26. Upon passage of the projection 26*a*, the microswitch $SW_3$ is turned off.

When the projection 26*a* further actuates the microswitch $SW_4$, turning the contact member thereof from contact *b* to contact a, a relay $RY_4$ is energized through a contact 2A3, with the result that the relay $RY_4$ is self-maintained by way of the contact *b* of the microswitch $SW_2$ and a contact 4A1 and energizes the motor $M_D$ for the developing means 9 through a contact 4A2. Thus the magnetic roller 69 rotates to visualize the electrostatic latent image on the photoreceptor 6 which is passing through the developing station. When the projection 67*a* has passed by the microswitch $SW_4$ through further rotation of the control cam 67, the switch $SW_4$ is closed at the contact *b* thereof.

Further rotation of the control cam 67 causes the projection 67*a* to operate the microswitch $SW_5$, whereupon a relay $RY_5$ is energized by way of the contact 1A5 and is self-maintained through the contact a of the microswitch $SW_B$ and a contact 5A2 and energizes the solenoid 163 of the paper feed means 12 through a contact 5A1. Upon passage of the projection 67*a*, the microswitch $SW_5$ is turned off.

The operation of the solenoid 163 thus initiated rotates the arms 156, permitting the stopper lugs 159 of the stop plate 158 to retract downward from the window 161 in the lower guide plate 160, while preshing up the driven rollers 153. Consequently, the paper which has been prevented from forward movement by the stopper lugs 159 is pressed against the feed rollers 152 which are rotating all the time and carried through the path 166 toward the peripheral surface of the photoreceptor 6.

When the rear end of the paper has moved past the actuators of the microswitches $SW_A$ and $SW_B$, the switch $SW_A$ is turned off and the switch $SW_B$ is closed at the contact *b* to drive the motor $M_T$, causing the feed roller 132 to send out the subsequent sheet of paper. At the same time, the relay $RY_5$ is turned off to deenergize the solenoid 163, since the microswitch $SW_5$ is in an off state. The rotary plate 162 therefore returns under the action of the spring 164, causing the driven rollers 153 to disengage from the feed rollers 152 and retract downwardly of the lower guide plate 160, while allowing the stopper lugs 159 to project to the path of the paper through the window 161 in the lower guide plate 160. The sheet of paper subsequently sent out by the feed roller 132 is stopped by the stopper lugs 159 upon striking the lugs.

On the other hand, the preceding sheet of paper sent forward toward the photoreceptor is guided by the guide plates defining the path 166 and brought into fitting contact with the photoreceptor 6 bearing a developed visible image, with the leading end of the paper slightly positioned ahead of the front end of the photoreceptor 6 as shown in FIGS. 13 and 14 and then sent to the transfer means 10.

Just before the paper reaches the transfer means 10, the projection 67*a* of the control cam 67 in rotation actuates the microswitch $SW_6$ and energizes a relay $RY_6$ through a contact 4A3, the relay $RY_6$ thereby being self-maintained by way of the contact *b* of the microswitch $SW_4$ and a contact 6A1. The relay further supplies current to the transfer means 10 through a contact 6A2 to operate the same and thereby transfer the powder image from the photoreceptor 6 onto the paper that is passing through the transfer station in contact with the photoreceptor 6.

After passing over the guide roller 14, the paper, now bearing the image of the original, is peeled off the photoreceptor 6 by a jet of air supplied from the peeling means 15 and is delivered onto the conveyor means 16. While passing under the heat-fixing means 17, the paper lying flat on the conveyor belt 168 under the action of the suction means 18 is subjected to heat-fixing and then delivered onto the copy receiver 3 outside the machine.

The microswitch $SW_7$, when actuated by the projection 67*a* due to further rotation of the control cam 67, frees the relay $RY_1$ from the self-maintaining state with its contacts 1A1, 1A2, 1A3, 1A4 and 1A5 opened, the opening of the contact 1A3 relieving the relay $RY_2$ from the self-maintaining state and opening the contacts 2A1, 2A2 and 2A3, whereupon the corona discharge is terminated in the charging means 7. The switch $SW_7$ closes its contact upon passage of the projection 76*a*.

The rotation of the control cam 67 further operates the microswitch $SW_8$ with its projection 67*a*. However, if the presetting counter circuits $P_1$ and $P_2$ are set to 1 sheet as shown, the switch $SW_8$ will not be actuated. The projection 67*a* further temporarily opens the microswitch $SW_1$ for detecting the leading end of the photoreceptor 6. However, since the clutch $CL_A$ which is still energized by way of the contact 6A3 keeps operating, the photoreceptor support 35 further rotates and the surface of the photoreceptor 6 is cleaned by the cleaner brush 116 which is rotating all the time.

On the other hand, the exposure optical system of the slit scanning type is moved in parallel with the surface of the document 26 to continuously project the image of the original document onto the photoreceptor 6 on the support. When the system reaches the left end position in FIG. 2, namely the position indicated by phantom line as at 21' and 23', the first carriage 21 actuates the microswitch $SW_O$ for return movement to open the contact thereof and free the relay $RY_3$ from the self-maintaining state. Accordingly, the contacts 3A1 and 3A2 are opened to turn off the light source 27, while the clutch $CL_B$ for driving the scanning wheel 46 is disengaged, with the result that the first and second carriages 21 and 23 rapidly return to the starting position under the action of the spiral spring 52 in the scanning wheel 46. At the terminal position of this return movement, they are brought to a halt under the control of the already described shock absorbing means. The force of the spring 52 is so determined that the return movement will be completed before the projection 67*a* of the control cam operates the contact of the microswitch $SW_2$.

When the control cam further rotates, permitting the projection 67*a* to operate the microswitch $SW_2$ again, the switch $SW_2$ is closed at the contact a, but since the contact 1A2 is open, the relay $RY_2$ and the charging means 7 will not function. On the other hand, the opening of the contact b frees the relay $RY_4$ from the self-maintaining state to deenergize the motor $M_D$ for the developing means 9. The microswitch $SW_2$ is closed at the contact b upon the passage of the projection 67*a*.

Further rotation of the control cam 67 causes the projection 67*a* to operate the microswitch $SW_3$. However, the contact 1A4 being open, the relay $RY_3$, the clutch $CL_B$ for the exposure optical system and the light source 27 will not operate, and the microswitch $SW_3$ is opened upon the passage of the projection 67*a*.

When the projection 67*a* then operates the microswitch $SW_4$ to close the contact a thereof, the developing means 9 does not operate, because the contact 2A3 is open. On the other hand, the contact b, now open, frees the relay $RY_6$ from the self-maintaining state and the transfer means 10 stops corona discharge. The passage of the projection 67*a* closes the contact b of the microswitch $SW_4$ again.

Even when the projection 67*a* operates the microswitches $SW_5$ and $SW_6$ in succession due to further rotation of the cam 67, the relays $RY_5$ and $RY_6$ will not operate since the contacts 1A5 and 4A3 are open. The switches $SW_5$ and $SW_6$ are opened again when the projection 27*a* was passed.

Because the relay $RY_5$ is out of operation, the paper is still retained by the stopper lugs 159 and the relay $RY_6$ which is unenergized does not permit the transfer means 10 to operate.

Further even when the microswitches $SW_7$ and $SW_8$ are operated as the cam projection 67*a* passes by these switches, the operation means associated therewith will not function. When the microswitch $SW_1$ is operated to open the contact thereof, the clutch $CL_A$ is disengaged since the contact 6A3 is now open, with the result that the photoreceptor support 35 and the control cam 67 are brought to a halt, with the cam projection 67*a* keeping the microswitch $SW_1$ open.

In brief, when a single copy is made, the photoreceptor support 35 and the control cam 67 respectively rotate two turns in synchronism. During the first turn of rotation, the image forming and copying operations are conducted, and during the second turn of rotation, the paper transport and cleaning operations are performed.

When a plurality of copies, for example, six copies are to be made from one original, the contacts of the presetting counter circuits $P_1$ and $P_2$ are set to the position corresponding to six copies. Then the main switch $S_M$ is turned on. After the operation means associated with the switch $S_M$ has started operating as previously described, the start switch $S_S$ is depressed to rotate the photoreceptor support 35, causing the same to perform the image forming and copying operations during the first turn of rotation. At this time, even if the projection 67*a* operates the microswitch $SW_7$ just before the control cam 67 completes one turn of rotation, the relay $RY_1$ is kept in self-maintaining state by the counter circuit $P_1$ unlike in the previous case wherein the relay $RY_1$ is freed from the self-maintaining state. More specifically, since the switch $SW_7$ is connected in parallel with the counter circuit $P_1$ which includes contacts for making a plurality of copies connected in series but independent of the contact for making a single copy, the circuit $P_1$, when the contact thereof is set to a contact for a plurality of copies, bypasses the switch $SW_7$ until a single copy is left to be copied. For this reason, after the photoreceptor support 35 makes the first turn of rotation and until the number of turns set on the counter circuit are completed, copying operation is carried out repeatedly in succession.

When the microswitch $SW_8$ is operated by the cam projection 67*a*, the solenoid SOL in the counter functions to reduce the set number of the copies on the counter circuits $P_1$ and $P_2$ in the sequence of 5, 4, 3, 2, 1 as the support rotates. When the set number is reduced to 1, the circuit $P_1$ in parallel with the microswitch $SW_7$ and the circuit $P_2$ in series with the microswitch $SW_8$ are opened by the counter. After the same operation as the operation of making a single copy has been performed, namely after the last image forming and copying operation has been made, the support 35 and the control cam 67 rotate another turn for the aforementioned cleaning operation.

Thus if six copies are to be made, an image forming and copying operation is performed for the first copy during the first turn of rotation of the photoreceptor support 35. Paper transport, cleaning and the image forming copying operations for each of the subsequent copies are performed during each turn of the rotation thereafter made until six turns of rotation are completed. Finally, during the seventh turn of rotation, the transport of the sixth copy and a cleaning operation are conducted.

In the case where the number of the copies to be made is more than the number of copies to be indicated on the presetting counter, the counter circuits $P_1$ and $P_2$ are set at a contact M. In this case, the solenoid SOL will not operate despite the operation of the microswitch $SW_8$, while the relay $RY_1$ is self-maintained independently of the operation of the switch $SW_7$ for a continuous copy making operation.

Thus with the copier of this invention, by closing the main switch $S_M$, the paper is sent to the stopper lugs 159 of the feed means 12. The paper brought to this position renders the start switch $S_S$ ready for operation. In making a single copy, closing of the switch $S_S$ permits the movement of the photoreceptor support 35 and the control cam 67 and permits the relay $RY_1$ to be self-maintained. The relay $RY_1$ in the self-maintaining state permits the operation of the charging means 7 and self-maintenance of the relay $RY_2$ through the action of the switch $SW_2$. The operation of the switch $SW_3$ enables the exposure optical system to operate. The switch $SW_5$, when actuated, frees the paper from retention. Since the relay $RY_2$ is in self-maintaining state, the operation of the switch $SW_4$ further works the developing means 9 and brings the relay $RY_4$ to the self-maintaining state, which permits the switch $SW_6$, when operated, to drive the transfer means 10 and to bring the relay $R_6$ to the self-maintaining state. This enables, even when the switch $SW_1$ is functioned, the photoreceptor support 35 and the control cam 67 to perform the second turn of rotation. When the relay $RY_1$ is freed from the self-maintaining state due to the action of the switch $SW_7$, the charging means 7 stops its operation. The action of the switch $SW_2$ which frees the relay $RY_4$ from the self-maintaining state stops the operation of the developing means 9. The relay $RY_6$ when freed from the self-maintaining state due to the operation of the switch $SW_4$ stops the transfer means. Through the operation of the switch $SW_1$ the photoreceptor support 35 and control cam 67 are brought to a halt.

Thus the receptive operations for image forming and copying are so arranged systematically that one operation permits another subsequent operation to take place. Should the paper fail to reach the predetermined position of the paper feed means 12 due to a trouble, the respective operation mechanisms will not operate even if the start switch is depressed, thus eliminating an idle image forming copying operation. When the main switch $S_M$ is turned off due to a trouble in the course of an image forming copying operation, namely when the cam projection 67*a* does not operate the switch $SW_1$, the closing of the main switch actuates the clutch $CL_A$ to drive the support 35 and the control cam 67 since the switch $SW_1$ is closed. When the projection 67*a* opens the switch $SW_1$, the support 35 and cam 67 are merely brought to a halt at a given position. This eliminates the possibility of copying operation being effected by the rotation resumed at an intermediate position.

Figure 28:
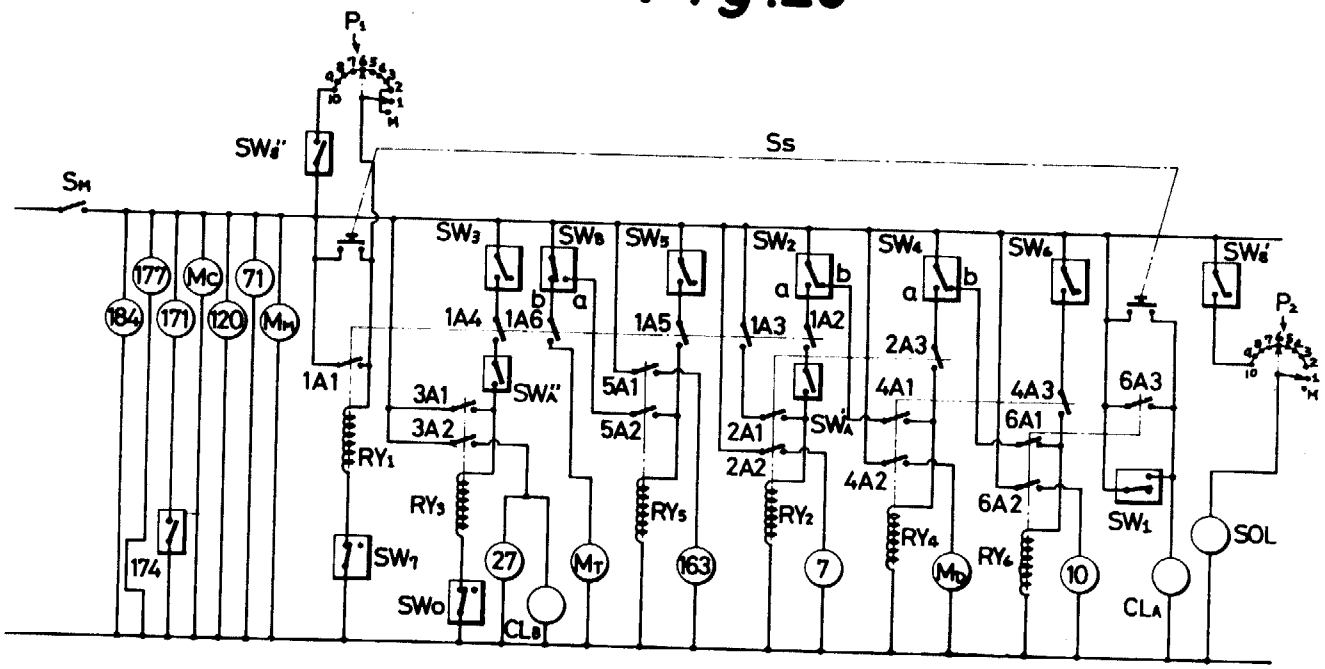
FIG. 28 is a diagram showing another example of the program circuit.

FIG. 28 shows an electric circuit to be employed for the copier of this invention. This circuit is different from that of FIG. 27 with respect to the following arrangements. The circuit of the motor $M_T$ for paper feeding operation includes a contact 1A6 to be operated by the relay $RY_1$ so as to effect the paper feeding operation upon depression of the start switch $S_S$. The microswitch $SW_A$ in FIG. 27 corresponds, in this embodiment, to microswitches $SW_A$ and $SW_A$ which are installed in the circuits of relays $RY_2$ and $RY_3$ respectively as illustrated, the arrangement being such that, when the paper has been used up or the paper is not sent to the stopper lugs 159 due to a trouble, the support 35 and the control cam 67 merely make a turn of rotation to avoid an idle copying operation. For a successive copying operation, the contacts of the presetting counter circuit $P_1$ are disposed in parallel with one of the contacts of the start switch $S_S$, and the microswitch $SW_8$ to be operated by the control cam 67 comprises two microswitches $SW_8$ and $SW_8$ which are positioned in the circuits of the presetting circuits $P_2$ and $P_1$ as illustrated. According to this arrangement, the relay $RY_1$ is freed from the self-maintaining state when the microswitch $SW_7$ functions and is brought back to the self-maintaining state when the switch $SW_8$ thereafter functions. Unlike with the circuit of FIG. 27, the paper will not be supplied to the paper feed means 12 as far as the start switch $S_S$ is not depressed, so that the magazine 2 containing paper can be readily loaded on or unloaded from the machine even with the main switch $S_M$ closed.

In the case where the photoreceptor support is in the form of a belt as in FIG. 26 in the foregoing description of the image forming and copying operation, a turn of rotation of the photoreceptor support corresponds to a cycle of movement of the support belt. The image forming and copying operation in this case is also carried out exactly in the same manner as with the photoreceptor support in the form of a drum.

I claim:

1. An electrophotographic copier of the transfer type comprising:

a document table made of a transparent plate;

an exposure optical system of the slit scanning type having means for scanning the surface of an original document disposed below said document table and movable in parallel with said document table;

an endless support supporting a photoreceptor and disposed below said exposure optical system and movable at a constant peripheral speed;

an image forming and copying assembly disposed around said endless support including means for charging said photoreceptor composed of a corona discharger, an exposure window positioned at the terminal end of the light path of said exposure optical system for exposing the charged photoreceptor to produce an electrostatic latent image, developing means for visualizing electrostatic latent image with a toner transfer means for transferring the powder image onto copy paper, and cleaner means for cleaning the surface of said photoreceptor;

a copy paper supply station including paper supply roller means for dispensing sheets of paper to be made into final copies, paper feed means for feeding the dispensed paper to said transfer means, conveyor means for discharging transferred paper out of said copier, and means disposed over the transport path of said conveyor means for heat-fixing the toner image on said transferred paper;

a control member disposed in the interior of said copier and rotatable in a predetermined synchronous relation with said endless support in synchronism therewith; and means including a program circuit for controlling the operation for a selective pre-selected number of copying cycles of said copier, and characterized in that:

said scanning means includes a first carriage synchronously driven in a predetermined relation to the moving speed of a photoreceptor support and a second carriage driven at half the speed of said first carriage, said first carriage being provided with a document illuminating system and a plane mirror for directing the image of the document to a plane mirror on said second carriage, said second carriage being provided with at least one plane mirror for reflecting the image of the original reflected by said plane mirror on said first carriage toward a projecting lens, the length of the light path from the surface of the document to said projecting lens being kept constant irrespective of the position of said first carriage; and said scanning means includes guide rails parallel to said document table, a roller rotatably mounted on said second carriage and rolling along said guide rails and said first carriage rests on said roller rolling on said guide rails, said first carriage and said second carriage being moved in operative relation at a speed ration of 1½.

2. An electrophotographic copier of the transfer type comprising:

a document table made of a transparent plate;

an exposure optical system of the slit scanning type having means for scanning the surface of an original document disposed below said document table and movable in parallel with said document table;

an endless support supporting a photoreceptor and disposed below said exposure optical system and movable at a constant peripheral speed;

an image forming and copying assembly disposed around said endless support including means for charging said photoreceptor composed of a corona discharger, an exposure window positioned at the terminal end of the light path of said exposure optical system for exposing the charged photoreceptor to produce an electrostatic latent image, developing means for visualizing the electrostatic latent image with a toner, transfer means for transferring the powder image onto copy paper, and cleaner means for cleaning the surface of said photoreceptor;

a copy paper supply station including paper supply roller means for dispensing sheets of paper, paper feed means for feeding the dispensed paper to said transfer means, conveyor means for discharging transferred paper out of said copier, and means disposed over the transport path of said conveyor means for heat-fixing the toner image on said transferred paper;

a control member disposed in said copier and rotatable in a predetermined synchronous relation with said endless support; and means including a program circuit for controlling the operation for a selective pre-selected number of cycle of said copier, and characterized in that:

said scanning means includes a first carriage synchronously driven in a predetermined relation to the speed of the photoreceptor support and a second carriage driven at half the speed of said first carriage, said first carriage being provided with a document illuminating system and a plane mirror for directing the image of the document to a plane mirror on said second carriage, said second carriage being provided with at least one plane mirror for reflecting the image of the original reflected by said plane mirror on said first carriage toward a projecting lens, the length of the light path from the surface of the document to said projecting lens being kept constant irrespective of the position of said first carriage; and said scanning means includes a scanning wheel coupled with the endless support drive by way of an electromagnetic clutch and having a circumference equal to the length of said endless support, said wheel being rotatable at a peripheral speed equal to the linear speed of said support, interconnecting belts extending from the outer periphery of said wheel to said first carriage for advancing said first carriage in forward and reverse directions respectively, and a wind-up spring wound up when said wheel is driven in a forward direction, and said carriages are forwardly advanced by the forward rotation of said wheel and actuate a switch for disengaging said electromagnetic clutch upon completion of said forward travel, whereupon said wheel is reversed to return said carriages under the restoring action of said spring.

3. An electrophotographic copier of the transfer type comprising:

a document table made of a transparent plate;

an exposure optical system of the slit scanning type having means for scanning the surface of an original document disposed below said document table and movable in parallel with said document table;

an endless support supporting a photoreceptor and disposed below said exposure optical system and movable at a constant peripheral speed;

an image forming and copying assembly disposed around said endless support including means for charging said photoreceptor composed of a corona discharger, an exposure window positioned at the terminal end of the light path of said exposure optical system for exposing the charged photoreceptor to produce an electrostatic latent image, developing means for visualizing the electrostatic latent image with a toner, transfer means for transferring the powder image onto copy paper, and cleaner means for cleaning the surface of said photoreceptor;

a copy paper supply station including paper supply roller means for dispensing sheets of copy paper, paper feed means for feeding the dispensed paper to said transfer means, conveyor means for discharging transferred paper out of said copier, and means disposed over the transport path of said conveyor means for heat-fixing the toner image on said transferred paper;

a control member disposed in said copier and rotatable in a predetermined synchronous relation with said endless support; and means including a program circuit for controlling the operation for a selective pre-selected number of cycles of said copier, and characterized in that:

said scanning means includes a first carriage synchronously driven in a predetermined relation to the speed of the photoreceptor support and a second carriage driven at half the speed of said first carriage, said first carriage being provided with a document illuminating system and a plane mirror for directing the image of the document to a plane mirror on said second carriage, said second carriage being provided with at least one plane mirror for reflecting the image of the original reflected by said plane mirror on said first carriage toward a projecting lens, the length of the light path from the surface of the document to said projecting lens being kept constant irrespective of the position of said first carriage; and said scanning means includes a member rotatable in synchronism with the movement of said carriages, a shock absorbing mechanism functioning at the terminal position of return travel of said first and second carriages, said shock absorbing mechanism comprising a pin mounted on said rotatable member, a rotary plate having a recess for releasably engaging said pin, an extendable arm having one end pivoted to said rotary plate and the other end supported on a fixed pin and a spring coupled to said arm so as to exert a shock absorbing action on said rotary plate simultaneously with the engagement of said pin by said recess.

4. An electrophotographic copier of the slit exposure type for forming an electrostatic image of an original document on a moving member comprising:

a scanning means for projecting an image of the original onto said moving member including a first carriage synchronously driven in a predetermined relation to the moving speed of said moving member and a second carriage driven at half the speed of said first carriage, said first carriage being provided with an original illuminating system and a mirror for directing the image of the original to said second carriage provided with at least one mirror for reflecting the image of the original reflected by said mirror on said first carriage toward a projecting lens, the length of the light path from the original to said projecting lens being kept constant irrespective of the position of said first carriage; and said scanning means further including guide rails parallel to the movement of said first and second carriages and a rotatory member rotatably mounted on said second carriage and rolling along said guide rails, said first carriage resting on said rotatory member rolling on said guide rails, said first and second carriages being moved in operative relation at a speed ratio of 1½.

5. An electrophotographic copier of the slit exposure type for forming an electrostatic image of an original document on a moving member comprising:

a scanning means for projecting an image of the original onto said moving member including a first carriage synchronously driven in a predetermined relation to the moving speed of said moving member and a second carriage driven at half the speed of said first carriage, said first carriage being provided with an original illuminating system and a mirror for directing the image of the original to said second carriage provided with at least one mirror for reflecting the image of the original reflected by said mirror on said first carriage toward a projecting lens, the length of the light path from the original to said projecting lens being kept constant irrespective of the position of said first carriage; and said scanning means further including a first and second guide rail parallel to the movement of said first and second carriages with the first rail mounted on said first carriage and the second rail supporting said second carriage, a rotatory member rotatably mounted between said first and second rails and rotatable with respect to the movement of said first rail, the ratio of the movement speed of said first rail to that of said rotatory member being 1½ so that said first and second carriages are moved in operative relation at a speed ratio of 1½.

* * * * *

UNITED STATES PATENT OFFICE

CERTIFICATE OF CORRECTION

Patent No. 3,951,540 Dated April 20, 1976

Inventor(s) Masaya Ogawa

It is certified that error appears in the above-identified patent and that said Letters Patent are hereby corrected as shown below:

Column 7, line 13, "1 1/2" should read -- 1:1/2 --.

Column 28, line 20, "ration of 1 1/2" should read -- ratio of 1:1/2 --. Column 30, line 41, "1 1/2" should read -- 1:1/2 --.

Column 30, line 68, "1 1/2" should read -- 1:1/2 --.

Column 31, line 2, "1 1/2" should read -- 1:1/2 --.

Signed and Sealed this

Second Day of November 1976

[SEAL]

*Attest:*

RUTH C. MASON
*Attesting Officer*

C. MARSHALL DANN
*Commissioner of Patents and Trademarks*